US009857747B2

(12) United States Patent
Kaneko et al.

(10) Patent No.: US 9,857,747 B2
(45) Date of Patent: Jan. 2, 2018

(54) IMAGE FORMING APPARATUS THAT ADJUSTS A VOLTAGE OUTPUT BASED ON TONER ADHESION

(71) Applicants: Satoshi Kaneko, Kanagawa (JP); Shuji Hirai, Tokyo (JP)

(72) Inventors: Satoshi Kaneko, Kanagawa (JP); Shuji Hirai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/924,826

(22) Filed: Oct. 28, 2015

(65) Prior Publication Data

US 2016/0124367 A1 May 5, 2016

(30) Foreign Application Priority Data

Oct. 30, 2014 (JP) ..... 2014-221465

(51) Int. Cl.

*G03G 15/00* (2006.01)
*G03G 15/06* (2006.01)
*G03G 15/16* (2006.01)

(52) U.S. Cl.

CPC ..... *G03G 15/556* (2013.01); *G03G 15/065* (2013.01); *G03G 15/1675* (2013.01); *G03G 15/5058* (2013.01)

(58) Field of Classification Search

CPC ..... G03G 15/556

(Continued)

(56) References Cited

U.S. PATENT DOCUMENTS 5,987,272 A * 11/1999 Maeda ..... G03G 15/0173 399/44
8,965,227 B2 * 2/2015 Mizutani ..... G03G 15/1675 399/53

(Continued)

FOREIGN PATENT DOCUMENTS

EP 2 787 393 A2 10/2014
JP 9-062042 3/1997

(Continued)

OTHER PUBLICATIONS

U.S. Appl. No. 14/726,847, filed Jun. 1, 2015, Satoshi Kaneko, et al.

(Continued)

*Primary Examiner* — Walter L Lindsay, Jr.
*Assistant Examiner* — Arlene Heredia Ocasio
(74) *Attorney, Agent, or Firm* — Oblon, McClelland, Maier & Neustadt, L.L.P.

(57) ABSTRACT

An image forming apparatus that includes an imaging device, a transferrer, a rotator, a rotation position sensor, an adhesion amount sensor, a power supply, and a controller. The controller executes a construction process to construct output pattern data to change a voltage output from the power supply, according to a result obtained by detecting a toner adhesion amount of a toner image for density unevenness detection and a detection result from the rotation position sensor obtained when the toner image is formed, and an output change process to execute a predetermined process while changing the voltage according to the detection result and the output pattern data. The controller executes a determination process to determine propriety of an output range of the voltage output from the power supply by the output change process and a data process for a shift to shift the range when a determination result is inappropriate.

22 Claims, 11 Drawing Sheets

(58) Field of Classification Search
USPC ..... 399/49, 53
See application file for complete search history.

(56) References Cited

U.S. PATENT DOCUMENTS

| | | | | |
|---|---|---|---|---|
| 2004/0042813 | A1 | 3/2004 | Takai | |
| 2005/0185973 | A1* | 8/2005 | Hama | G03G 15/556 399/27 |
| 2008/0145078 | A1* | 6/2008 | Tomita | G03G 15/5058 399/60 |
| 2009/0080913 | A1* | 3/2009 | Suzuki | G03G 15/0853 399/30 |
| 2011/0044705 | A1* | 2/2011 | Akashi | G03G 15/0131 399/27 |
| 2012/0201552 | A1 | 8/2012 | Hirai et al. | |
| 2013/0108292 | A1* | 5/2013 | Suzuki | G03G 15/0189 399/49 |
| 2013/0243456 | A1 | 9/2013 | Kaneko et al. | |
| 2013/0243457 | A1 | 9/2013 | Kaneko et al. | |
| 2014/0169814 | A1 | 6/2014 | Uematsu et al. | |
| 2014/0268242 | A1 | 9/2014 | Kaneko et al. | |
| 2014/0270827 | A1 | 9/2014 | Muto et al. | |
| 2014/0270828 | A1* | 9/2014 | Suzuki | G03G 15/065 399/55 |
| 2014/0301748 | A1* | 10/2014 | Suzuki | G03G 15/5025 399/49 |
| 2015/0261162 | A1 | 9/2015 | Kaneko et al. | |

FOREIGN PATENT DOCUMENTS

| | | | |
|---|---|---|---|
| JP | 2000-098675 | | 4/2000 |
| JP | 2007065119 A | * | 3/2007 |
| JP | 2012-163645 | | 8/2012 |
| JP | 2012 173390 A | | 9/2012 |
| JP | 2012-173390 A | | 9/2012 |

OTHER PUBLICATIONS

Office Action issued Mar. 22, 2016, in European Patent Application No. 15192239.0 (English Translation).

Extended European Search Report issued Mar. 22, 2016 in Patent Application No. 15192239.0.

* cited by examiner

| FIG. 6A |
| --- |
| FIG. 6B |

IMAGE FORMING APPARATUS THAT ADJUSTS A VOLTAGE OUTPUT BASED ON TONER ADHESION

CROSS-REFERENCE TO RELATED APPLICATION

This patent application is based on and claims priority pursuant to 35 U.S.C. §119(a) to Japanese Patent Application No. 2014-221465, filed on Oct. 30, 2014, in the Japan Patent Office, the entire disclosure of which is hereby incorporated by reference herein.

BACKGROUND

Technical Field

Aspects of the present disclosure relate to an image forming apparatus.

Related Art

Conventionally, an image forming apparatus that constructs output pattern data to change an output from a power supply according to a predetermined pattern, according to a detection result of a rotation position of a rotator and a detection result of image density unevenness of a toner image for density unevenness detection formed by an imaging device, has been known.

SUMMARY

In an aspect of the present disclosure, there is provided an image forming apparatus that includes an imaging device, a transferer, a rotator, a rotation position sensor, an adhesion amount sensor, a power supply, and a controller. The imaging device forms a toner image on a moving surface of an image bearer. The transferer transfers the toner image on the image bearer to a recording sheet directly or via an intermediate transferer. The rotation position sensor detects a rotation position of the rotator. The adhesion amount sensor detects a toner adhesion amount of the toner image formed by the imaging device. The power supply outputs a voltage contributing to a predetermined process in a course from formation to transfer of the toner image. The controller executes a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor obtained when the toner image for the density unevenness detection is formed, and an output change process to execute the predetermined process while changing the voltage output from the power supply, according to the detection result from the rotation position sensor and the output pattern data. The controller executes a determination process to determine propriety of an output range of the voltage output from the power supply by the output change process and a data process for a shift to shift the output range when a determination result in the determination process is inappropriate.

In another aspect of the present disclosure, there is provided an image forming apparatus that includes an imaging device, a transferer, a rotator, a rotation position sensor, an adhesion amount sensor, a power supply, and a controller. The imaging device forms a toner image on a moving surface of an image bearer. The transferer transfers the toner image on the image bearer to a recording sheet directly or via an intermediate transferer. The rotation position sensor detects a rotation position of the rotator. The adhesion amount sensor detects a toner adhesion amount of the toner image formed by the imaging device. The power supply outputs a voltage contributing to a predetermined process in a course from formation to transfer of the toner image. The controller executes a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor obtained when the toner image for the density unevenness detection is formed, an output change process to execute the predetermined process while changing the voltage output from the power supply, according to the detection result from the rotation position sensor and the output pattern data, and a reference value determination process to determine a reference value of an output from the power supply, according to a result obtained by detecting toner adhesion amounts of a plurality of toner images for toner adhesion amount detection formed by the imaging device under different imaging conditions by the adhesion amount sensor. The controller executes a correction process to correct a target toner adhesion amount referred to when the reference value is determined by the reference value determination process or the reference value determined by the reference value determination process, according to a predetermined condition being met.

In still another aspect of the present disclosure, there is provided an image forming apparatus that includes an imaging device, a transferer, a rotator, a rotation position sensor, an adhesion amount sensor, a power supply, and a controller. The imaging device forms a toner image on a moving surface of an image bearer. The transferer transfers the toner image on the image bearer to a recording sheet directly or via an intermediate transferer. The rotation position sensor detects a rotation position of the rotator. The adhesion amount sensor detects a toner adhesion amount of the toner image formed by the imaging device. The power supply outputs a voltage contributing to a predetermined process in a course from formation to transfer of the toner image. The controller executes a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor obtained when the toner image for the density unevenness detection is formed, an output change process to execute the predetermined process while changing the voltage output from the power supply, according to the detection result from the rotation position sensor and the output pattern data, and a reference value determination process to determine a reference value of an output from the power supply, according to a result obtained by detecting toner adhesion amounts of a plurality of toner images for toner adhesion amount detection formed by the imaging device under different imaging conditions by the adhesion amount sensor. The controller determines the reference value as a value in a range from a predetermined lower limit to a predetermined upper limit, by the reference value determination process.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
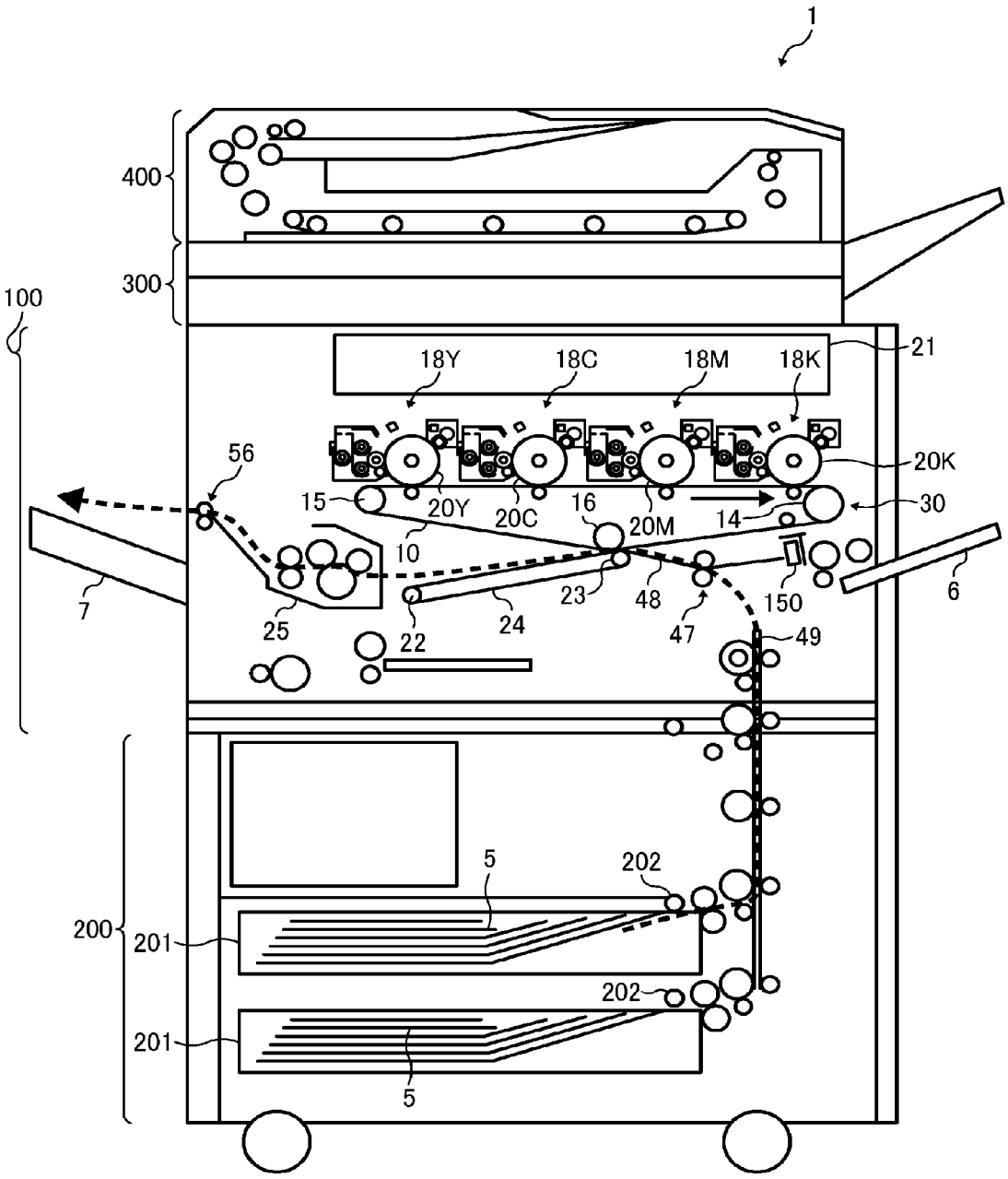
FIG. 1 is a schematic view of a configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

For example, an image forming apparatus forms a toner image for density unevenness detection on a photoconductor while detecting the rotation position of the photoconductor to be the rotator by a rotary encoder to be a rotation position sensor, at predetermined timing such as detection timing of a large environment variation. In addition, after transferring the toner image for the density unevenness detection to an intermediate transfer belt, the image forming apparatus grasps the image density unevenness occurring with a rotation cycle of the photoconductor in the toner image for the density unevenness detection, by a reflective photosensor. The image density unevenness occurs when a development gap between the photoconductor and a developing sleeve of a developing device varies with the rotation cycle of the photoconductor, due to eccentricity or external distortion of the photoconductor. If the image density unevenness is grasped, output pattern data to generate an output pattern of a developing bias to cancel the image density unevenness is constructed. Then, when an image based on a command from a user is formed, the developing bias is changed according to the output pattern data, so that occurrence of the image density unevenness synchronized with the rotation cycle of the photoconductor can be suppressed.

In such a configuration, the image density unevenness occurring with the rotation cycle of the photoconductor may not be suppressed due to an output upper limit and an output lower limit of a developing power supply outputting the developing bias. For example, though the developing bias needs to be changed in a range of −700 [V] to −500 [V], the output upper limit of the power supply may be −650 [V]. In this case, though the developing bias needs to be returned to −651 [V] after the developing bias is changed from −651 [V] to −700 [V] in a predetermined period in one cycle of the photoconductor, the constant developing bias −650 [V] should be output. In addition, occurrence of the image density unevenness may not be suppressed in the period.

When the developing bias needs to be changed to a value below the output lower limit of the power supply as well as when the developing bias needs to be changed to a value beyond the output upper limit of the power supply, occurrence of the image density unevenness may not be suppressed in the predetermined period in one cycle of the photoconductor, similarly to the above case.

In the image forming apparatus, the image density unevenness may occur with a rotation cycle of the rotator different from the photoconductor. For example, the image density unevenness is image density unevenness synchronized with the rotation cycle of the rotator, such as a charging roller charging the photoconductor uniformly, a developing sleeve developing an electrostatic latent image on the photoconductor, and a transfer roller contacting the photoconductor or an intermediate transferrer and forming a transfer nip. The image density unevenness occurs due to electrical resistance unevenness of a circumferential direction of the charging roller, eccentricity or external distortion of the developing sleeve, and electrical resistance unevenness of a circumferential direction of the transfer roller. However, even when an output such as a charging bias, a developing bias, and a transfer bias is changed according to the output pattern data to suppress occurrence of the image density unevenness, it may be difficult to suppress the image density unevenness due to the output upper limit and the output lower limit of the power supply, similarly to the above case.

As described below, according to at least one embodiment of the present disclosure, in a configuration in which an output from a power supply is changed according to output pattern data, occurrence of image density unevenness can be surely suppressed, regardless of an output upper limit and an output lower limit of the power supply.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, an image forming apparatus according to an embodiment of the present disclosure illustrated as an electrophotographic full-color copier (hereinafter, simply referred to as a copier) will be described with reference to FIG. 1.

First, a basic configuration of an image forming apparatus 1 according to the embodiment will be described. FIG. 1 is a schematic view of a configuration of the image forming apparatus 1 according to the embodiment. In FIG. 1, the image forming apparatus 1 includes an image forming device 100 that forms an image on a recording sheet, a sheet feeder 200 that supplies a recording sheet 5 to the image forming device 100, and a scanner 300 that reads an image of a document. The image forming apparatus 1 further includes an automatic document feeder (ADF) 400 that is mounted on the scanner 300. A manual feed tray 6 to set the recording sheet 5 manually and a stack tray 7 to stack the image formed recording sheet 5 are provided in the image forming device 100.

Figure 2:
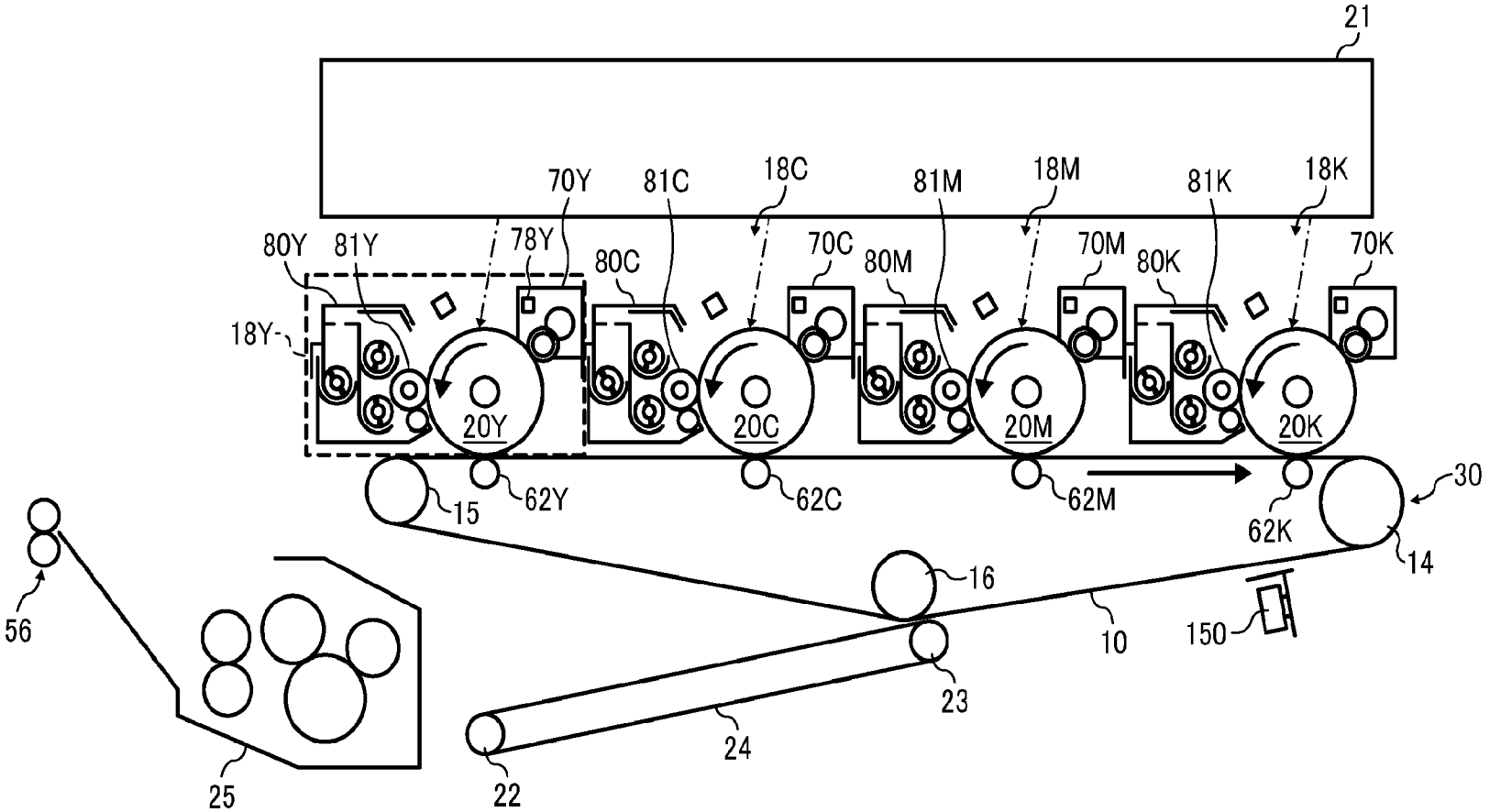
FIG. 2 is an enlarged view of a configuration of an image forming device of the image forming apparatus according to an embodiment.

FIG. 2 is an enlarged view of a configuration of the image forming device 100. The image forming device 100 is provided with a transfer unit including an endless intermediate transfer belt 10 to be a transferrer. The intermediate transfer belt 10 of the transfer unit endlessly moves in a clockwise direction in the drawings by rotation of any one of three support rollers 14, 15, and 16, in a state in which the intermediate transfer belt 10 is stretched on the three support rollers 14, 15, and 16. Four imaging units for yellow (Y), cyan (C), magenta (M), and black (K) face a surface of a belt portion moving between the first support roller 14 and the second support roller 15 among the support rollers 14, 15, and 16. In addition, an optical sensor unit 150 to detect an image density (toner adhesion amount per unit area) of a toner image formed on the intermediate transfer belt 10 faces a surface of a belt portion moving between the second support roller 15 and the third support roller 16.

In FIG. 1, a laser writer 21 is provided on imaging units 18Y, 18C, 18M, and 18K. The laser writer 21 emits write light, according to image information of the document read by the scanner 300 or image information transmitted from an external personal computer not illustrated in the drawings. Specifically, a semiconductor laser (not illustrated in the drawings) is driven by a laser controller not illustrated in the drawings and emits the write light, according to the image information. In addition, drum-shaped photoconductors 20Y, 20C, 20M, and 20K to be latent image bearers provided in the imaging units 18Y, 18C, 18M, and 18K are exposed and scanned by the write light and electrostatic latent images are formed on the photoconductors. A light source of the write light is not limited to the laser diode and may be an LED, for example.

Figure 3:
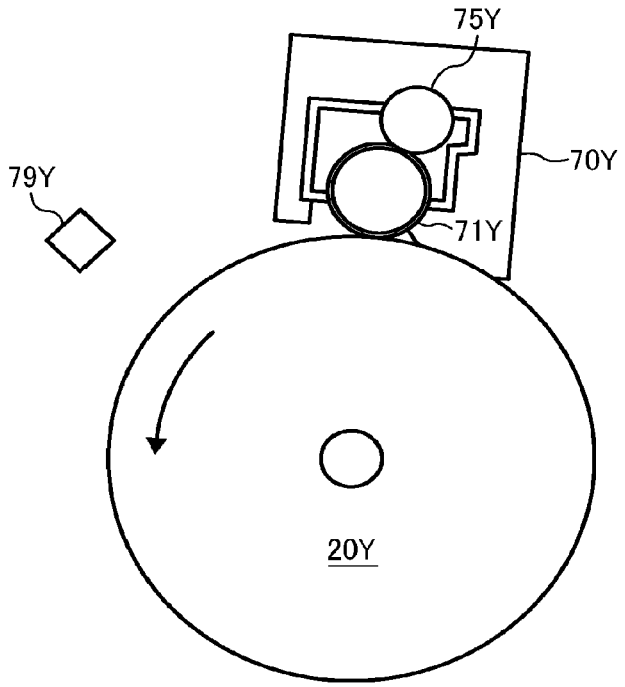
FIG. 3 is an enlarged view of a configuration of a photoconductor and a charging device for Y in the image forming device according to an embodiment.

FIG. 3 is an enlarged view of a configuration of the photoconductor 20Y and a charging device 70Y for Y. The charging device 70Y has a charging roller 71Y contacting the photoconductor 20Y and rotating along with the photoconductor 20Y, a charger cleaning roller 75Y contacting the charging roller 71Y and rotating along with the charging roller 71Y, a rotation position sensor describer later, and a surface potential sensor 79Y.

Figure 4:
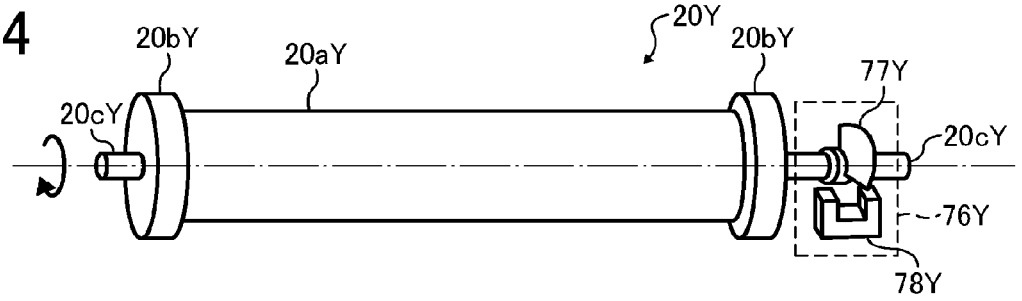
FIG. 4 is an enlarged perspective view of the photoconductor according to an embodiment.

FIG. 4 is an enlarged perspective view of the photoconductor 20Y for Y. The photoconductor 20Y has a columnar body 20*a*Y, large-diameter flanges 20*b*Y arranged on both sides of a rotation-axial direction of the body 20*a*Y, and rotation shafts 20*c*Y rotatably supported to a bearing not illustrated in the drawings.

One of the rotation shafts 20*c*Y protruding from edge faces of the two flanges 20*b*Y passes through a photoconductor rotation sensor 76Y and a portion protruding from the photoconductor rotation sensor 76Y is received by a bearing not illustrated in the drawings. The photoconductor rotation sensor 76Y includes a shield 77Y fixed to the rotation shaft 20*c*Y and rotating integrally with the rotation shaft 20*c*Y and a transmissive photosensor 78Y. The shield 77Y is formed to protrude in a normal direction in a predetermined place on a circumferential face of the rotation shaft 20*c*Y. When the photoconductor 20Y takes a predetermined rotation position, the shield 77Y is interposed between a light emitting element and a light receiving element of the transmissive photosensor 78Y. As a result, the light receiving element does not receive light, so that an output voltage value from the transmissive photosensor 78Y greatly decreases. That is, if the photoconductor 20Y takes the predetermined rotation position, the transmissive photosensor 78Y detects the position and greatly decreases the output voltage value.

Figure 5:
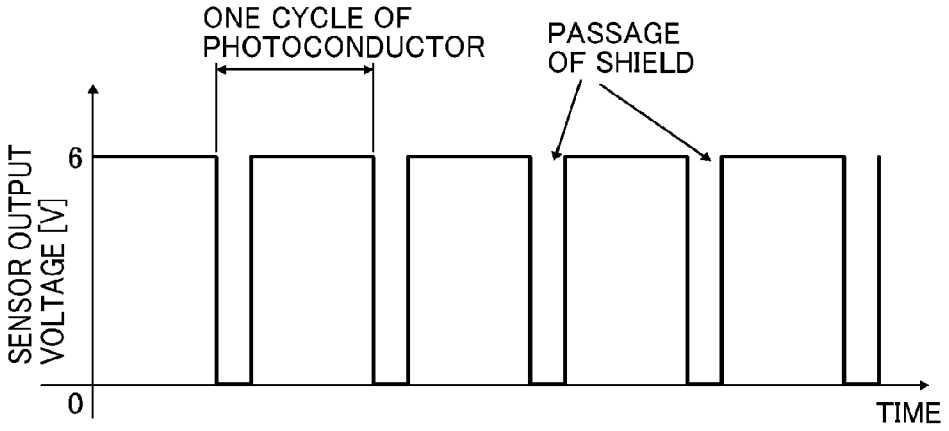
FIG. 5 is a graph illustrating a temporal change of an output voltage from a photoconductor rotation sensor for Y according to an embodiment.

FIG. 5 is a graph illustrating a temporal change of an output voltage from the photoconductor rotation sensor 76Y for Y. The output voltage from the photoconductor rotation sensor 76Y is an output voltage from the transmissive photosensor 78Y, specifically. As illustrated in FIG. 5, when the photoconductor 20Y rotates, a voltage of 6 [V] is output from the photoconductor rotation sensor 76Y for most of time. However, the output voltage from the photoconductor rotation sensor 76Y greatly decreases to about 0 [V] for only a moment, whenever the photoconductor 20Y goes round. This is because the shield 77Y is interposed between the light emitting element and the light receiving element of the transmissive photosensor 78Y and the light receiving element does not receive light, whenever the photoconductor 20Y goes round. Timing at which the output voltage greatly decreases as described above is timing at which the photoconductor 20Y takes the predetermined rotation position. Hereinafter, the timing is called reference position timing.

In FIG. 3, the charger cleaning roller 75Y of the charging device 70Y includes a conductive cored bar and an elastic layer coated on a circumferential face of the cored bar. The elastic layer is made of a sponge-shaped member obtained by foaming melamine resin finely and rotates while contacting the charging roller 71Y. In addition, according to rotation, dust such as a residual toner adhered to the charging roller 71Y is removed from the body, so that occurrence of an abnormal image is suppressed.

In FIG. 2, the four imaging units 18Y, 18C, 18M, and 18K have almost the same configuration, except that colors of toners to be used are different from each other. If the imaging unit 18Y for Y forming a Y toner image is exemplified, the imaging unit 18Y has the photoconductor 20Y, the charging device 70Y, and a developing device 80Y.

A surface of the photoconductor 20Y is charged uniformly by the charging device 70Y to have a negative polarity. A potential of a portion of the surface of the photoconductor 20Y uniformly charged in this way, which the laser writer 21 irradiates with laser light, is attenuated and the portion becomes an electrostatic latent image.

The developing device 80Y is a developing device of two-component development that performs developing using a two-component developer containing a magnetic carrier and a non-magnetic toner. However, a developing device of one-component development using a one-component developer not containing the magnetic carrier may be adopted. The developing device 80Y includes a stirrer and a developing device provided in a developing case. In the stirrer, the two-component developer (hereinafter, simply referred to as a developer) is stirred and transported by three screws and is supplied to the developing device. In the developing device, a developing sleeve 81Y that rotates while causing a part of a circumferential face thereof to face the photoconductor 20Y with a predetermined gap therebetween through an opening of the developing case is disposed. The developing sleeve 81Y to be a developer bearer includes a magnet roller not illustrated in the drawings to prevent the magnet roller from rotating by itself. The developer supplied from the stirrer to the developing device is scooped up on the surface of the developing sleeve 81Y by an action of magnetic force from the magnet roller. The developer scooped up on the surface of the developing sleeve 81Y is transported to a developing region facing the photoconductor 20Y according to rotation of the developing sleeve 81Y. Before the transport, the developer enters a napping state by the magnetic force from the magnet roller and forms a magnetic brush. In the developing region, a developing potential to dislocate the toner of the developer to the electrostatic latent image on the photoconductor 20Y is acted by the developing bias applied to the developing sleeve 81Y. As a result, the toner of the developer is transferred to the electrostatic latent image on the photoconductor 20 and develops the electrostatic latent image. In this way, a Y toner image is formed on the photoconductor 20Y. The Y toner image enters a primary transfer nip for Y to be described below, according to the rotation of the photoconductor 20Y.

The developer having passed through the developing region according to the rotation of the developing sleeve 81Y is transported to a region where the magnetic force of the magnet roller becomes weak, so that the developer is separated from the surface of the developing sleeve 81Y and returns to the stirrer. The developer having returned to the stirrer is stirred and transported by the three screws and is supplied again to the developing device. Before the supply, a toner density of the developer is detected by a toner density sensor and a toner of an amount according to a detection result is supplied newly. The supply is performed when a controller not illustrated in the drawings drives a toner supply device not illustrated in the drawings, according to the detection result from the toner density sensor.

Formation of the Y toner image in the imaging unit 18Y for Y has been described. However, in the imaging units 18C, 18M, and 18K for C, M, and K, a C toner image, an M toner image, and a K toner image are formed on surfaces of the photoconductors 20C, 20M, and 20K, respectively, by the same process as the imaging unit 18Y for Y.

Primary transfer rollers 62Y, 62C, 62M, and 62K for Y, C, M, and K are disposed on the inside of a loop of the intermediate transfer belt 10 and the intermediate transfer belt 10 is interposed between the primary transfer rollers 62Y, 62C, 62M, and 62K and the photoconductors 20Y, 20C, 20M, and 20K for Y, C, M, and K. As a result, primary transfer nips for Y, C, M, and K in which a surface of the intermediate transfer belt 10 and the photoconductors 20Y, 20C, 20M, and 20K for Y, C, M, and K contact each other are formed. In addition, a primary transfer field is formed between the primary transfer rollers 62Y, 62C, 62M, and 62K for Y, C, M, and K to which a primary transfer bias is applied and the photoconductors 20Y, 20C, 20M, and 20K.

The surface of the intermediate transfer belt 10 sequentially passes through the primary transfer nips for Y, C, M, and K, according to the endless movement of the belt. In this course, the Y toner image, the C toner image, the M toner image, and the K toner image on the photoconductors 20Y, 20C, 20M, and 20K are sequentially superimposed on the surface of the intermediate transfer belt 10 and are primarily transferred to the intermediate transfer belt 10. As a result, a four-color superimposed toner image is formed on the surface of the intermediate transfer belt 10.

An endless conveyance belt 24 stretched by a first stretching roller 22 and a second stretching roller 23 is disposed below the intermediate transfer belt 10 and endlessly moves in a counterclockwise direction in the drawings, according to rotation of any stretching roller. In addition, a surface of the endless conveyance belt 24 contacts a winding place for the third support roller 16 in an entire region of the intermediate transfer belt 10 and a secondary transfer nip is formed. In the vicinity of the secondary transfer nip, a secondary transfer field is formed between the grounded second stretching roller 23 and the third support roller 16 to which the secondary transfer bias is applied.

In FIG. 1, a conveyance passage 48 to sequentially transport the recording sheet 5 fed from the sheet feeder 200 or the manual feed tray 6 to the secondary transfer nip and a fixing device 25 and an ejection roller pair 56 to be described below is provided in the image forming device 100. In addition, a feed passage 49 to transport the recording sheet 5 fed from the sheet feeder 200 to the image forming device 100 to an entrance of the conveyance passage 48 is provided. A registration roller pair 47 is disposed in the entrance of the conveyance passage 48.

If a print job starts, the recording sheet 5 delivered from the sheet feeder 200 or the manual feed tray 6 is transported to the conveyance passage 48 and hits the registration roller pair 47. In addition, the registration roller pair 47 starts rotation at appropriate timing and feeds the recording sheet 5 to the secondary transfer nip. In the secondary transfer nip, the four-color superimposed toner image on the intermediate transfer belt 10 is adhered to the recording sheet 5. By an action of the secondary transfer field or a nip pressure, the four-color superimposed toner image is secondarily transferred to the surface of the recording sheet 5 and a full-color toner image is obtained.

The recording sheet 5 having passed through the secondary transfer nip is transported to the fixing device 25 by the conveyance belt 24. In addition, the recording sheet 5 is pressurized and heated in the fixing device 25, so that the full-color toner image is fixed on the surface thereof. Then, the recording sheet 5 is ejected from the fixing device 25 and is stacked on the stack tray 7 via the ejection roller pair 56.

Figures 6, 6A:
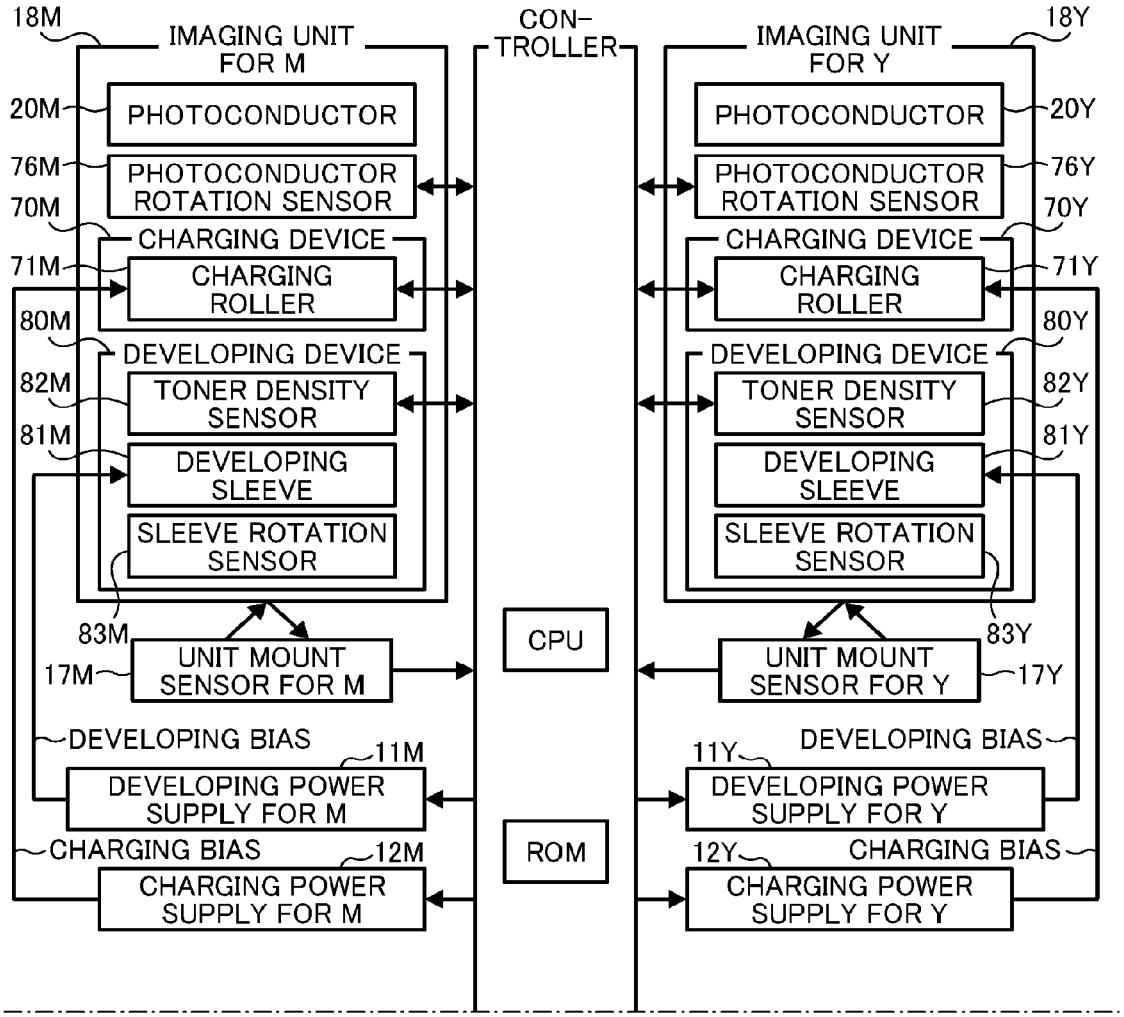
FIGS. 6A and 6B (collectively referred to as FIG. 6) are block diagrams of a main portion of an electric circuit of the image forming apparatus according to an embodiment.
Figure 6B:
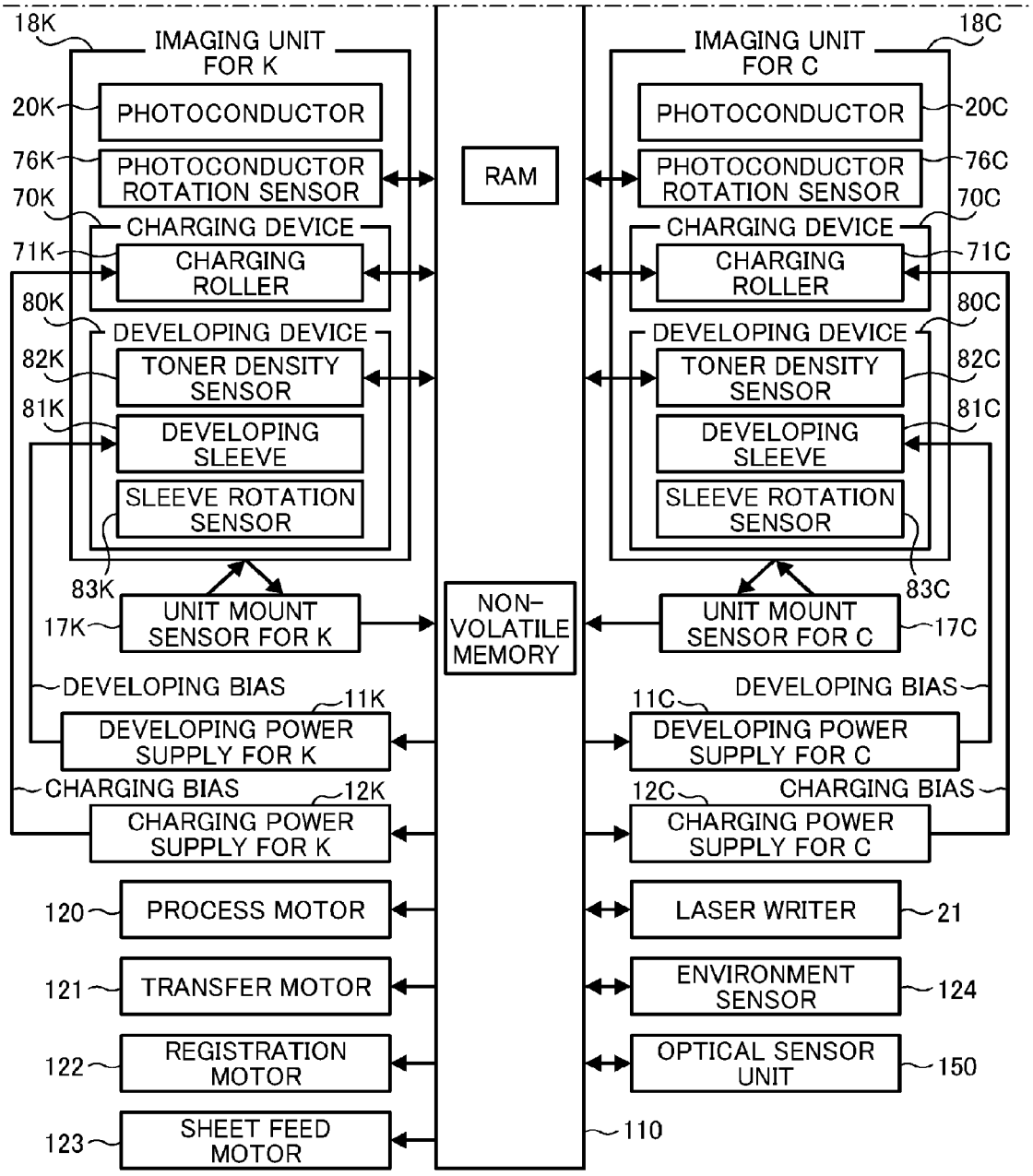

FIGS. 6A and 6B (collectively referred to as FIG. 6) are block diagrams of a main portion of an electric circuit of the image forming apparatus 1. In FIG. 6, a controller 110 has a central processing unit (CPU), a random access memory (RAM), a read only memory (ROM), and a non-volatile memory. Toner density sensors 82Y, 82C, 82M, and 82K of the developing devices 80Y, 80C, 80M, and 80K for Y, C, M, and K are electrically connected to the controller 110. As a result, the controller 110 can grasp toner densities of a Y developer, a C developer, an M developer, and a K developer accommodated in the developing devices 80Y, 80C, 80M, and 80K for Y, C, M, and K.

In addition, unit mount sensors 17Y, 17C, 17M, and 17K for Y, C, M, and K are electrically connected to the controller 110. The unit mount sensors 17Y, 17C, 17M, and 17K for Y, C, M, and K functioning as mount sensors can detect that the imaging units 18Y, 18C, 18M, and 18K are separated from the image forming device 100 or the imaging units 18Y, 18C, 18M, and 18K are mounted on the image forming device 100. As a result, the controller 110 can grasp that the imaging units 18Y, 18C, 18M, and 18K are separated from or mounted on the image forming device 100.

In addition, developing power supplies 11Y, 11C, 11M, and 11K for Y, C, M, and K are electrically connected to the controller 110. The controller 110 individually outputs a control signal to each of the developing power supplies 11Y, 11C, 11M, and 11K, so that a value of a developing bias output from each of the developing power supplies 11Y, 11C, 11M, and 11K can be individually controlled. That is, a value of a developing bias applied to each of the developing sleeves 81Y, 81C, 81M, and 81K for Y, C, M, and K can be individually controlled.

In addition, charging power supplies 12Y, 12C, 12M, and 12K for Y, C, M, and K are electrically connected to the controller 110. The controller 110 individually outputs a control signal to each of the charging power supplies 12Y, 12C, 12M, and 12K, so that a value of a direct-current voltage in a charging bias output from each of the charging power supplies 12Y, 12C, 12M, and 12K can be individually controlled. That is, a value of a direct-current voltage in a charging bias applied to each of the charging rollers 71Y, 71C, 71M, and 71K for Y, C, M, and K can be individually controlled.

In addition, photoconductor rotation sensors 76Y, 76C, 76M, and 76K to individually detect that the photoconductors 20Y, 20C, 20M, and 20K for Y, C, M, and K take predetermined rotation positions are electrically connected to the controller 110. The controller 110 can individually grasp that the photoconductors 20Y, 20C, 20M, and 20K for Y, C, M, and K take the predetermined rotation positions, according to outputs from the photoconductor rotation sensors 76Y, 76C, 76M, and 76K.

In addition, sleeve rotation sensors 83Y, 83C, 83M, and 83K of the developing devices 80Y, 80C, 80M, and 80K are electrically connected to the controller 110. The sleeve rotation sensors 83Y, 83C, 83M, and 83K to be rotation position sensors detect that the developing sleeves 81Y, 81C, 81M, and 81K take predetermined rotation positions, by the same configurations as the photoconductor rotation sensors 76Y, 76C, 76M, and 76K. That is, the controller 110 can individually grasp timings at which the developing sleeves 81Y, 81C, 81M, and 81K take the predetermined rotation positions, according to outputs from the sleeve rotation sensors 83Y, 83C, 83M, and 83K.

In addition, the laser writer 21, an environment sensor 124, an optical sensor unit 150, a process motor 120, a transfer motor 121, a registration motor 122, and a sheet feed motor 123 are electrically connected to the controller 110. The environment sensor 124 detects a temperature or humidity in the image forming apparatus 1. In addition, the process motor 120 is a motor that becomes a drive source of the imaging units 18Y, 18C, 18M, and 18K. In addition, the transfer motor 121 is a motor that becomes a drive source of the intermediate transfer belt 10. In addition, the registration motor 122 is a motor that becomes a drive source of the registration roller pair 47. In addition, the sheet feed motor 123 is a motor that becomes a drive source of a pickup roller 202 to feed the recording sheet 5 from a sheet feed tray 201 of the sheet feeder 200. A function of the optical sensor unit 150 will be described below.

In the image forming apparatus 1, control called a process control process is executed regularly at predetermined timing to stabilize an image density over a long period, regardless of an environment variation. In the process control process, a Y patch pattern image including a plurality of patch-shaped Y toner images is formed on the photoconductor 20Y for Y and is transferred to the intermediate transfer belt 10. Each of the plurality of patch-shaped Y toner images is a toner image for toner adhesion amount detection to detect a Y toner adhesion amount. The controller 110 forms C, M, and K patch pattern images on the photoconductors 20C, 20M, and 20K by the same method and transfers the patch pattern images to the intermediate transfer belt 10 not to be superimposed. In addition, a toner adhesion amount of each toner image in the patch pattern images is detected by the optical sensor unit 150. Next, an imaging condition such as a developing bias reference value to be a reference value of a developing bias Vb is adjusted individually for each of the imaging units 18Y, 18C, 18M, and 18K, according to a detection result.

The optical sensor unit 150 has four reflective photosensors arranged at a predetermined interval in a belt width direction of the intermediate transfer belt 10. Each reflective photosensor outputs a signal according to optical reflectance of the intermediate transfer belt 10 or the patch-shaped toner image on the intermediate transfer belt 10. Both regular reflection light and diffused reflection light on a belt surface are captured and an output according to each light amount is executed, such that three reflective photosensors of the four reflective photosensors execute outputs according to a Y toner adhesion amount, a C toner adhesion amount, and an M toner adhesion amount.

Figure 7:
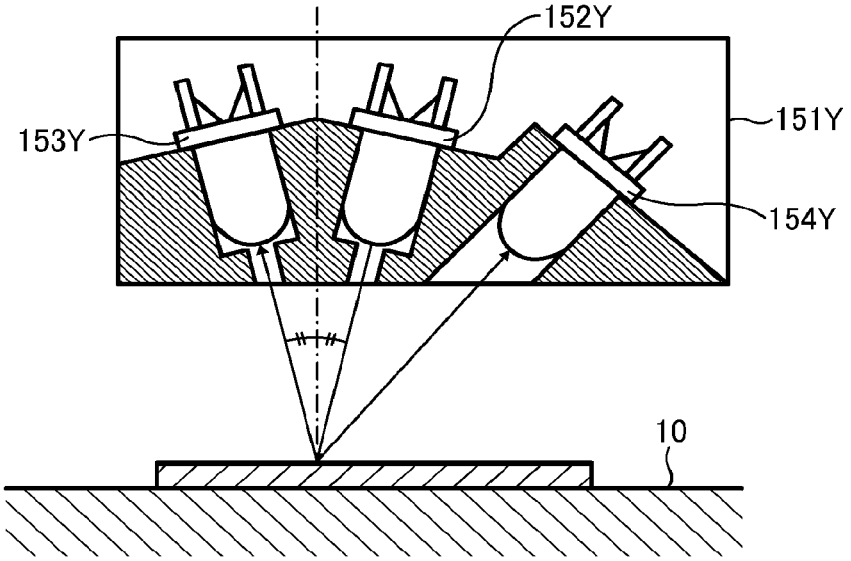
FIG. 7 is an enlarged view of a configuration of a reflective photosensor for Y mounted on an optical sensor unit of the image forming apparatus according to an embodiment.

FIG. 7 is an enlarged view of a configuration of a reflective photosensor 151Y for Y mounted on the optical sensor unit 150. The reflective photosensor 151Y for Y includes an LED 152Y functioning as a light source, a regular reflective light receiving element 153Y receiving the regular reflection light, and a diffused reflective light receiving element 154Y receiving the diffused reflection light. The regular reflective light receiving element 153Y outputs a voltage according to a light amount of the regular reflection light obtained from a surface of the Y patch-shaped toner image. In addition, the diffused reflective light receiving element 154Y outputs a voltage according to a light amount of the diffused reflection light obtained from the surface of the Y patch-shaped toner image. The controller 110 can calculate the Y toner adhesion amount of the Y patch-shaped toner image, according to the voltages. The reflective photosensor 151Y for Y has been described. However, the reflective photosensors 151C and 151M for C and M have the same configuration as the reflective photosensor 151Y for Y.

Figure 8:
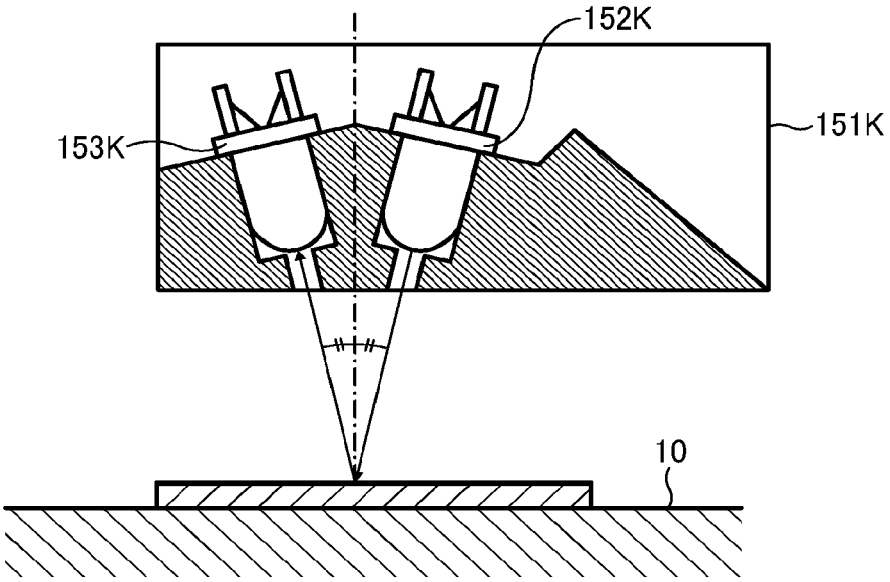
FIG. 8 is an enlarged view of a configuration of a reflective photosensor for K mounted on the optical sensor unit according to an embodiment.

FIG. 8 is an enlarged view of a configuration of the reflective photosensor 151K for K mounted on the optical sensor unit 150. The reflective photosensor 151K for K includes an LED 152K to be a light source and a regular reflective light receiving element 153K receiving the regular reflection light. The regular reflective light receiving element 153K outputs a voltage according to a light amount of the regular reflection light obtained from a surface of the K patch-shaped toner image. The controller 110 can calculate the K toner adhesion amount of the K patch-shaped toner image, according to the voltages.

As the LEDs (152Y, 152C, 152M, and 152K), a GaAs infrared-emitting diode in which a peak wavelength of emitted light is 950 nm is used. As the regular reflective light receiving elements (153Y, 153C, 153M, and 153K) or the diffused reflective light receiving elements (154Y, 154C, and 154M), an Si phototransistor in which peak light reception sensitivity is 800 nm is used. However, the peak wavelength or the peak light reception sensitivity is not limited to the value described above.

A gap of about 5 [mm] is provided between the four reflective photosensors and the surface of the intermediate transfer belt 10.

The controller 110 executes the process control process at predetermined timing such as a power supply mode of a main power supply not illustrated in the drawings, a standby mode after a predetermined time passes, and a standby mode after predetermined printed pages or more are output. If the process control process starts, first, a developing characteristic in each of the imaging units 18Y, 18C, 18M, and 18K is grasped after environment information such as a plan paper number, a coverage, a temperature, and a humidity is acquired. Specifically, developing γ and a developing start voltage are calculated for each color. More specifically, each of the photoconductors 20Y, 20C, 20M, and 20K is charged uniformly while the photoconductors 20Y, 20C, 20M, and 20K are rotated. For charging, a charging bias different from a charging bias at the time of normal print is output as a charging bias output from the charging power supplies 12Y, 12C, 12M, and 12K. Specifically, an absolute value of a direct-current voltage in the direct-current voltage and an alternating-current voltage of a charging bias composed of a superimposed bias is not constant and gradually increases. The laser writer 21 scans the photoconductors 20Y, 20C, 20M, and 20K charged under the above condition with the laser light and a plurality of electrostatic latent images for the patch-shaped Y toner image, the patch-shaped C toner image, the patch-shaped M toner image, and the patch-shaped K toner image are formed. The electrostatic latent images are developed by the developing devices 80Y, 80C, 80M, and 80K, so that Y, C, M, and K patch pattern images are formed on the photoconductors 20Y, 20C, 20M, and 20K. At the time of developing, the controller 110 gradually increases the absolute value of the developing bias applied to each of the developing sleeves 81Y, 81C, 81M, and 81K of the individual colors. At this time, a difference of a post-exposure potential (electrostatic latent image potential) in each patch-shaped toner image and the developing bias is stored as a developing potential in the RAM.

Figure 9:
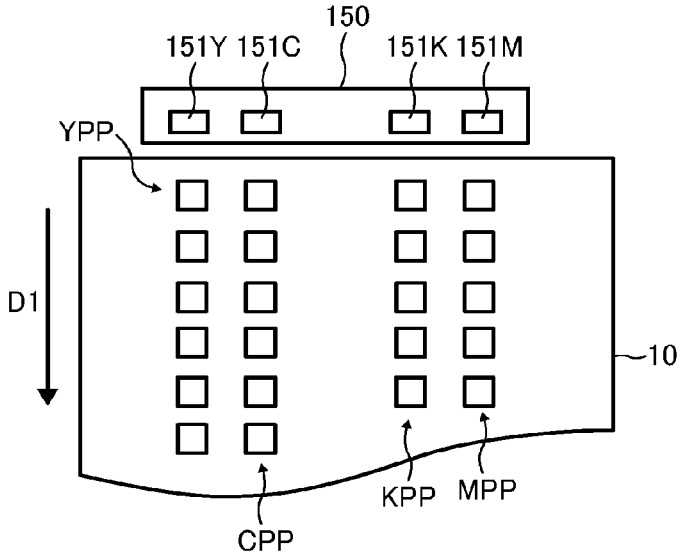
FIG. 9 is a schematic plan view of a patch pattern image of each color transferred to an intermediate transfer belt of the image forming device according to an embodiment.

The Y, C, M, and K patch pattern images are arranged in a belt width direction not to be superimposed on the intermediate transfer belt 10, as illustrated in FIG. 9. Specifically, a Y patch pattern image YPP is transferred to one end of the intermediate transfer belt 10 in a width direction. In addition, a C patch pattern image CPP is transferred to a position shifted slightly closer to the center side than the Y patch pattern image in the belt width direction. In addition, an M patch pattern image MPP is transferred to the other end of the intermediate transfer belt 10 in a width direction. In addition, a K patch pattern image KPP is transferred to a position shifted slightly closer to the center side than the K patch pattern image in the belt width direction.

The optical sensor unit 150 has a reflective photosensor 151Y for Y to detect a light reflection characteristic of the belt at a different position of the belt width direction. The optical sensor unit 150 further has a reflective photosensor 151C for C, a reflective photosensor 151K for K, and a reflective photosensor 151M for M.

The reflective photosensor 151Y for Y is disposed at a detection position of the Y toner adhesion amount of the Y patch-shaped toner image of the Y patch pattern image YPP formed on one end of the width direction of the intermediate transfer belt 10. In addition, the reflective photosensor 151C for C is disposed at a detection position of the C toner adhesion amount of the C patch-shaped toner image of the C patch pattern image CPP positioned at the vicinity of the Y patch pattern image YPP, in the belt width direction. In addition, the reflective photosensor 151M for M is disposed at a detection position of the M toner adhesion amount of the M patch-shaped toner image of the M patch pattern image MPP formed on the other end of the width direction of the intermediate transfer belt 10. In addition, the reflective photosensor 151K for K is disposed at a detection position of the K toner adhesion amount of the K patch-shaped toner image of the K patch pattern image KPP positioned at the vicinity of the M patch pattern image MPP, in the belt width direction.

The controller 110 operates optical reflectance of the patch-shaped toner image of each color according to the output signals sequentially transmitted from the four reflective photosensors of the optical sensor unit 150, calculates a toner adhesion amount according to an operation result, and stores the toner adhesion amount in the RAM. The patch pattern image of each color having passed through a position facing the optical sensor unit 150 according to travel of the intermediate transfer belt 10 is cleaned from the surface of the belt by a cleaning device not illustrated in the drawings.

Figure 10:
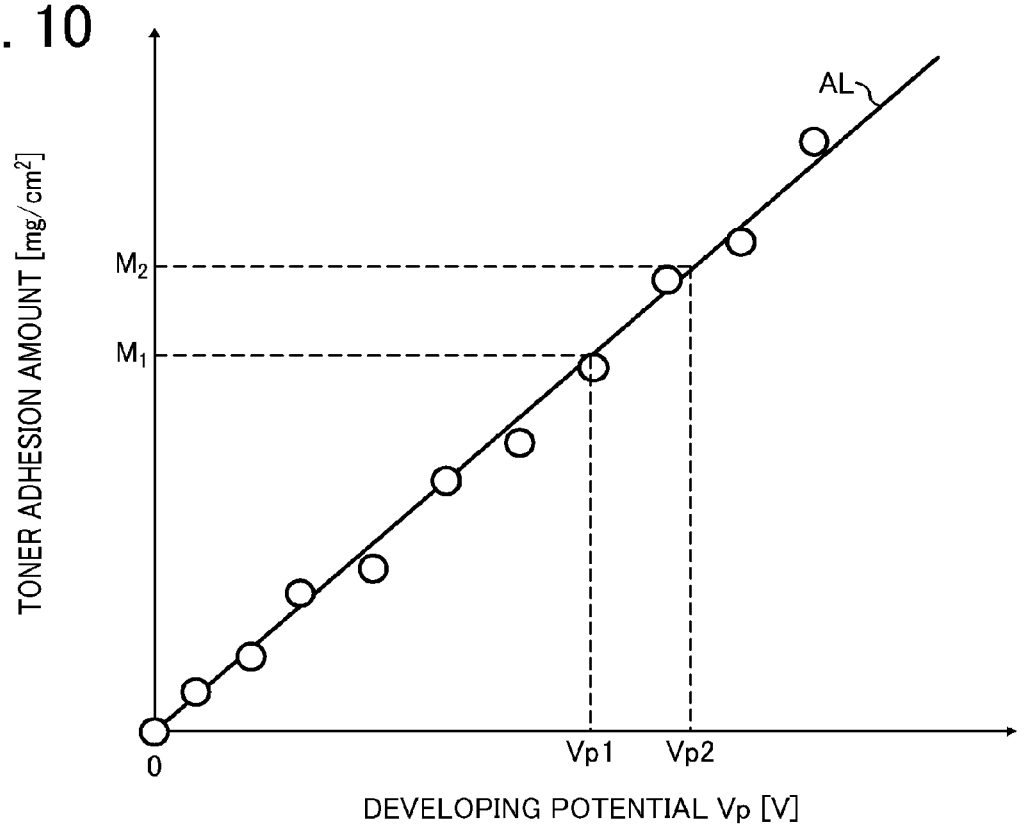
FIG. 10 is a graph illustrating an approximation linear expression of a relation of a toner adhesion amount and a developing bias constructed by a process control process according to an embodiment.

Next, the controller 110 calculates an approximation linear expression ($Y=a\times Vp+b$), according to the toner adhesion amount stored in the RAM and data of an exposed portion potential (latent image potential) in each patch toner image and data of a developing bias Vb, stored in the RAM separately from the toner adhesion amount. Specifically, as illustrated in FIG. 10, the approximation linear expression is an expression showing, as an approximation line (AL), a relation of the toner adhesion amount and the developing potential at the two-dimensional coordinates where a y axis shows the toner adhesion amount and an x axis shows the developing potential. In addition, a developing potential Vp to realize a target toner adhesion amount is calculated according to the approximation linear expression and a developing bias reference value to be the developing bias Vb to realize the developing potential Vp and a charging bias reference value (and LD power) are calculated. Calculation results are stored in a non-volatile memory. The developing bias reference value and the charging bias reference value (and the LD power) are calculated and stored for each color of Y, C, M, and K and the process control process ends. Then, in a print job, the developing bias Vb of the value based on the developing bias reference value stored in the non-volatile memory is output from the developing power supplies 11Y, 11C, 11M, and 11K, for Y, C, M, and K. In addition, the charging bias Vd of the value based on the charging bias reference value stored in the non-volatile memory is output from the charging power supplies 12Y, 12C, 12M, and 12K or the LD power is output from the laser writer 21.

By determining the developing bias reference value and the charging bias reference value (and the LD power) to realize the target toner adhesion amount by executing the process control process, an image density of an entire image can be stabilized over a long period, for each color of Y, C, M, and K. However, cyclic image density unevenness in a page may occur due to a variation of a development gap (hereinafter, referred to as a gap variation) between the photoconductors 20Y, 20C, 20M, and 20K and the developing sleeves 81Y, 81C, 81M, and 81K.

In the image density unevenness, image density unevenness occurring with a rotation cycle of the photoconductors 20Y, 20C, 20M, and 20K and image density unevenness occurring with a rotation cycle of the developing sleeves 81Y, 81C, 81M, and 81K are superimposed. Specifically, if rotation shafts of the photoconductors 20Y, 20C, 20M, and 20K are eccentric, a gap variation becoming a variation curve of a sine curve shape occurs for each round of the photoconductor, due to the eccentricity. As a result, in a developing field formed between the photoconductors 20Y, 20C, 20M, and 20K and the developing sleeves 81Y, 81C, 81M, and 81K, a field intensity variation becoming a variation curve of a sine curve shape occurs for each round of the photoconductor. In addition, image density unevenness becoming a variation curve of a sine curve shape occurs for each round of the photoconductor, due to the field intensity variation. In an external shape of the photoconductor surface, large distortion occurs. In addition, image density unevenness occurs due to a cyclic gap variation of a characteristic becoming the same pattern for each round of the photoconductor according to the distortion. In addition, cyclic image density unevenness occurs due to a gap variation of a sleeve rotation cycle by the eccentricity or the external distortion of the developing sleeves 81Y, 81C, 81M, and 81K. Particularly, the image density unevenness by the eccentricity or the external distortion of the developing sleeves 81Y, 81C, 81M, and 81K having diameters smaller than diameters of the photoconductors 20Y, 20C, 20M, and 20K occurs with a relative short cycle and is visualized.

Therefore, the controller 110 executes the following output change process for each color of Y, C, M, and K, at the time of the print job. That is, the controller 110 stores output pattern data of a developing bias to generate a developing field intensity variation capable of offsetting the image density unevenness occurring with the rotation cycle of the photoconductor in the non-volatile memory, for each color of Y, C, M, and K. In addition, the controller 110 stores output pattern data of a developing bias to generate a developing field intensity variation capable of offsetting the image density unevenness occurring with the rotation cycle of the developing sleeve in the non-volatile memory.

The output pattern data of the developing bias for the photoconductors 20Y, 20C, 20M, and 20K is an output pattern corresponding to one cycle of the photoconductors and shows a pattern based on reference position timing of the photoconductors 20Y, 20C, 20M, and 20K. Each output pattern data is used to change an output of the developing bias from the developing power supplies (11Y, 11C, 11M, and 11K) based on the developing bias reference value for Y, C, M, and K determined by the process control process functioning as reference value determination process. For example, when the output pattern data is pattern data of a data table type, a data group showing a developing bias output difference at a predetermined time interval is stored in a period of one cycle from the reference position timing. Data of a head of the data group shows the developing bias output difference at the reference position timing and second data, third data, fourth data . . . show developing bias output differences at the predetermined time interval thereafter. An output pattern including a data group called 0, −5, −7, −9 . . . show developing bias output differences at the predetermined time interval from the reference position timing as 0 [V], −5 [V], −7 [V], −9 [V] . . . . If the image density unevenness occurring with the rotation cycle of the photoconductor is only suppressed, a developing bias obtained by superimposing these values on the developing bias reference value may be output from the developing power supply. However, in the image forming apparatus 1, because the image density unevenness occurring with the rotation cycle of the developing sleeve is also suppressed, the developing bias output difference to suppress the image density unevenness of the rotation cycle of the photoconductor and the developing bias output difference to suppress the image density unevenness of the rotation cycle of the developing sleeve are superimposed.

The output pattern data of the developing bias for the developing sleeves 81Y, 81C, 81M, and 81K is an output pattern corresponding to one cycle of the developing sleeves and shows a pattern based on reference position timing of the developing sleeves 81Y, 81C, 81M, and 81K. Each output pattern data is used to change an output of the developing bias from the developing power supplies (11Y, 11C, 11M, and 11K) based on the developing bias reference value for Y, C, M, and K determined by the process control process functioning as reference value determination process. When the output pattern data is pattern data of a data table type, data of a head of the data group shows the developing bias output difference at the reference position timing and second data, third data, fourth data . . . show developing bias output differences at the predetermined time interval thereafter. The time interval is the same as the time interval in which the data group of the output pattern data for the photoconductors 20Y, 20C, 20M, and 20K is reflected.

When an imaging process is executed, the controller 110 reads data from the output pattern data for the photoconductors 20Y, 20C, 20M, and 20K at the predetermined time interval. At the same time, data is read from the output pattern data for the developing sleeves 81Y, 81C, 81M, and 81K at the same time interval. For each read, when the reference position timing does not arrive even though data is read until the last of the data group, a read value until the reference position timing arrives is set to the same value as the last data. When the reference position timing arrives before the data is read until the last of the data group, a read position of the data is returned to first data. For read of data from the output pattern data for the photoconductor, timing at which a reference position timing signal is transmitted from the photoconductor rotation sensors (76Y, 76C, 76M, and 76K) is set as the reference position timing. In addition, for read of data from the output pattern data for the developing sleeves, timing at which a reference position timing signal is transmitted from the developing sleeve rotation sensors (83Y, 83C, 83M, and 83K) is set as the reference position timing.

In the course of reading data for each of Y, C, M, and K, the data read from the output pattern data for the photoconductors and the data read from the output pattern data for the developing sleeves are added and a superimposed value is calculated. For example, when the data read from the output pattern data for the photoconductors is −5 [V] and the data read from the output pattern data for the developing sleeves is 2 [V], −5 [V] and 2 [V] are added and a superimposed value is calculated as −3 [V]. When the developing bias reference value is −550 [V], −553 [V] calculated by addition of the superimposed value is output from the developing power supply. This process is executed at a predetermined time interval for each of Y, C, M, and K.

As a result, a field intensity variation capable of offsetting a field intensity variation obtained by superimposing the following two field intensity variations is generated in the developing field between the photoconductors 20Y, 20C, 20M, and 20K and the developing sleeves 81Y, 81C, 81M, and 81K. That is, the field intensity variation is the field intensity variation due to the gap variation occurring with the photoconductor rotation cycle by the eccentricity or the external distortion of the photoconductors 20Y, 20C, 20M, and 20K and the field intensity variation occurring with the sleeve rotation cycle by the eccentricity or the external distortion of the developing sleeves 81Y, 81C, 81M, and 81K. In this way, an almost constant developing field is generated between the photoconductors and the developing sleeves, regardless of the rotation position of the photoconductors 20Y, 20C, 20M, and 20K or the developing sleeves 81Y, 81C, 81M, and 81K. As a result, both the image density unevenness occurring with the photoconductor rotation cycle and the image density unevenness occurring with the sleeve rotation cycle can be suppressed.

A construction process is executed at predetermined timing for the output pattern data of the developing bias for the photoconductors 20Y, 20C, 20M, and 20K or the output pattern data of the developing bias for the developing sleeves 81Y, 81C, 81M, and 81K and the output pattern data is constructed. The predetermined timing is timing before a first print job after a factory shipment (hereinafter, referred to as initial start timing) and detection timing of replacement of the imaging units 18Y, 18C, 18M, and 18K (hereinafter, referred to as replacement detection timing). At the initial start timing, the output pattern data of the developing bias for the photoconductors (hereinafter, referred to as photoconductor cycle output pattern data) is constructed for each of entire colors of Y, C, M, and K. In addition, the output pattern data of the developing bias for the developing sleeves (hereinafter, referred to as sleeve cycle output pattern data) is constructed. Meanwhile, at the replacement detection timing, the photoconductor cycle output pattern data and the sleeve cycle output pattern data are constructed for only the imaging unit of which the replacement has been detected. To enable the construction, the unit mount sensors 17Y, 17C, 17M, and 17K to detect replacements of the imaging units 18Y, 18C, 18M, and 18K individually are provided as illustrated in FIG. 6.

Figure 11:
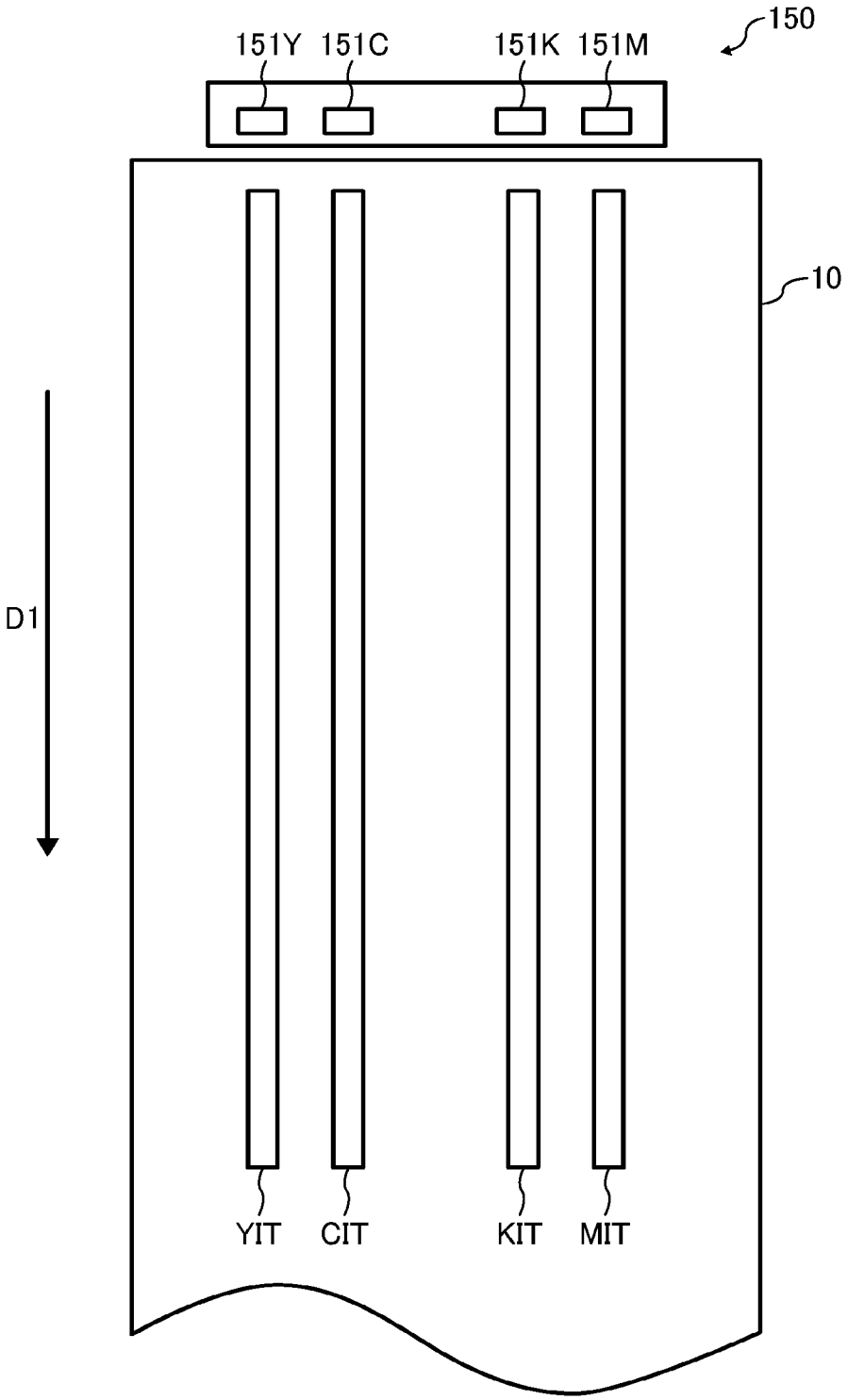
FIG. 11 is a schematic plan view of a toner image for density unevenness detection for each color transferred to the intermediate transfer belt of the image forming device according to an embodiment.

In the construction process at the initial start timing, first, a toner image for Y density unevenness detection including a Y solid toner image is formed on the photoconductor 20Y. In addition, a toner image for C density unevenness detection including a C solid toner image, a toner image for M density unevenness detection including an M solid toner image, and a toner image for K density unevenness detection including a K solid toner image are formed on the photoconductor 20C, the photoconductor 20M, and the photoconductor 20K, respectively. In addition, the toner images for the density unevenness detection are primarily transferred to the intermediate transfer belt 10, as illustrated in FIG. 11. In FIG. 11, because a toner image YIT for Y density unevenness detection is used to detect the image density unevenness occurring with the rotation cycle of the photoconductor 20Y, the toner image YIT is formed to have a length longer than a circumferential length of the photoconductor 20Y in a belt movement direction indicated by arrow D1 in FIG. 11. Likewise, lengths of a toner image CIT for C density unevenness detection, a toner image MIT for M density unevenness detection, and a toner image KIT for K density unevenness detection in the belt movement direction D1 are longer than circumferential lengths of the photoconductors 20C, 20M, and 20K.

In FIG. 11, an example of the case in which the four toner images (YIT, CIT, MIT, and KIT) for the density unevenness detection are formed to be arranged linearly in the belt width direction has been described for convenience. However, in actuality, a formation position of each toner image for density unevenness detection on the belt may be shifted by the same value as the circumferential length of the photoconductor to be a maximum value. This is because formation of the toner image for the density unevenness detection starts to match a leading edge position of the toner image for the density unevenness detection and a reference position (surface position of the photoconductor entering the developing region at the reference position timing) of the photoconductor in a circumferential direction, for each color. That is, the toner image for the density unevenness detection for each color is formed such that a leading edge thereof is matched with the reference position of the photoconductor in the circumferential direction.

In addition, the controller 110 executes the construction process and the process control process together. Specifically, the controller 110 executes the process control process immediately before executing the construction process and determines the developing bias reference value for each color. In addition, the controller 110 develops the toner image for the density unevenness detection under a condition of the developing bias reference value determined by the process control process for each color, in the construction process executed immediately after the process control process. For this reason, logically, the toner image for the density unevenness detection is formed to have a target toner adhesion amount. However, in actuality, minute density unevenness occurs due to the gap variation.

A value of a time lag until the leading edge of the toner image for the density detection enters a detection position by the reflective photosensor of the optical sensor unit 150 after formation of the toner image for the density unevenness detection starts (after write of the electrostatic latent image starts) is different for each color. However, in the case of the same colors, the time lag has a constant value over time (hereinafter, this value is referred to as a write-detection time lag).

The controller 110 previously stores the write-detection time lag in the non-volatile memory, for each color. When the write-detection time lag passes after the formation of the toner image for the density unevenness detection starts, sampling of an output from the reflective photosensor starts, for each color. The sampling is repeated at a predetermined time interval over one cycle of the rotation of the photoconductor. The time interval is the same value as a time interval to read each data in the output pattern data used in the output change process. The controller 110 constructs a density unevenness graph showing a relation of a toner adhesion amount (image density) and time (or the surface position of the photoconductor), according to sampling data, and extracts two density unevenness patterns from the density unevenness graph, for each color. One of the two density unevenness patterns is the density unevenness pattern occurring with the rotation cycle of the photoconductor. In addition, the other is the density unevenness pattern occurring with the rotation cycle of the developing sleeve.

If the controller 110 extracts the density unevenness pattern occurring with the rotation cycle of the photoconductor, according to the sampling data, for each color, the controller 110 calculates a toner adhesion amount average value (image density average value). The toner adhesion amount average value is a value in which almost an average value of a variation of the development gap at the rotation cycle of the photoconductor is reflected. Therefore, the controller 110 constructs photoconductor cycle output pattern data to offset the density unevenness pattern of the rotation cycle of the photoconductor, according to the toner adhesion amount average value. Specifically, the controller 110 calculates bias output differences corresponding to a plurality of toner adhesion amount data included in the density pattern. The bias output difference is based on the toner adhesion amount average value. The bias output difference corresponding to the toner adhesion amount data having the same value as the toner adhesion amount average value is calculated as zero.

In addition, the bias output difference corresponding to the toner adhesion amount data having a value larger than the toner adhesion amount average value is calculated as a value of a positive polarity according to a difference of a toner adhesion amount of the toner adhesion amount data and the toner adhesion amount average value. Because the bias output difference is the bias output difference of the positive polarity, the bias output difference is data to change a developing bias of a positive polarity as a value (value having a small absolute value) smaller than the developing bias reference value.

In addition, the bias output difference corresponding to the toner adhesion amount data having a value smaller than the toner adhesion amount average value is calculated as a value of a negative polarity according to a difference of a toner adhesion amount of the toner adhesion amount data and the toner adhesion amount average value. Because the bias output difference is the bias output difference of the negative polarity, the bias output difference is data to change a developing bias of a negative polarity as a value (value having a large absolute value) larger than the developing bias reference value.

In this way, the bias output differences corresponding to the individual toner adhesion amounts are calculated and data in which the bias output differences are arranged sequentially is constructed as the photoconductor cycle output pattern data to be the output pattern data.

In addition, if the controller 110 extracts the density unevenness pattern occurring with the rotation cycle of the developing sleeve, according to the sampling data, for each color, the controller 110 calculates a toner adhesion amount average value (image density average value). The toner adhesion amount average value is a value in which almost an average value of a variation of the development gap at the rotation cycle of the developing sleeve is reflected. Therefore, the controller 110 constructs sleeve cycle output pattern data to offset the density unevenness pattern of the rotation cycle of the developing sleeve, according to the toner adhesion amount average value. A specific method is the same as a method of constructing the photoconductor cycle output pattern data to offset the density unevenness pattern of the rotation cycle of the photoconductor.

As described above, an output is changed from the developing power supplies (11Y, 11C, 11M, and 11K) of the developing bias Vb in the output change process, using the photoconductor cycle output pattern data and the sleeve cycle output pattern data constructed in the construction process, for each color. As a result, the image density unevenness occurring with the rotation cycle of the photoconductor or the image density unevenness occurring with the rotation cycle of the developing sleeve can be suppressed.

However, cyclic occurrence of the image density unevenness may not be effectively suppressed due to the output upper limits or the output lower limits of the developing power supplies 11Y, 11C, 11M, and 11K. For example, the developing bias reference value=−800 [V] is assumed. In addition, an output value of the developing bias Vb is changed as follows according to the photoconductor cycle output pattern data to offset the image density unevenness of the photoconductor rotation cycle and the sleeve cycle output pattern data to offset the image density unevenness of the developing sleeve rotation cycle. That is, the output value is changed in a range of −785 [V] to −815 [V], using −800 [V] as a reference. However, if the output upper limit of the developing power supplies 11Y, 11C, 11M, and 11K is −800 [V], in spite of timing at which the developing bias Vb is changed to a value larger than −800 [V] originally, −800 [V] of the upper limit is output. At the corresponding timing, occurrence of the image density unevenness may not be suppressed.

When the developing bias Vb needs to be changed to a value smaller than the output lower limit as well as when the developing bias Vb needs to be changed to a value larger than the output upper limit, occurrence of the image density unevenness may not be suppressed at predetermined timing, similarly to the above case.

Figure 12:
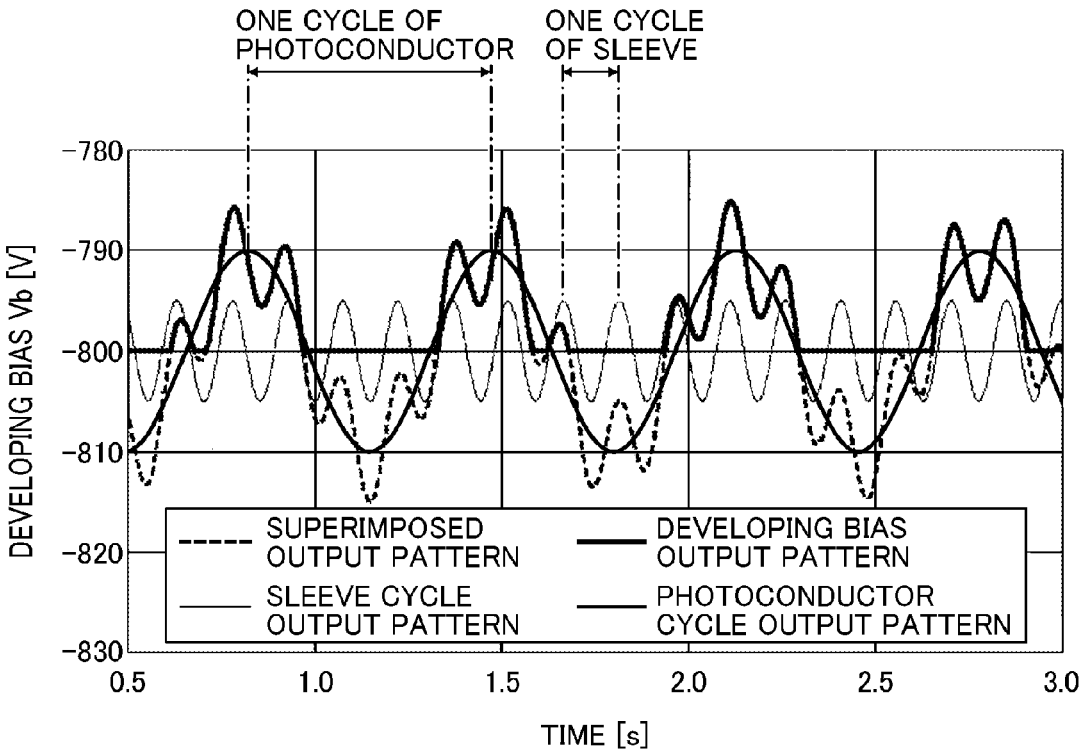
FIG. 12 is a graph illustrating an example of a relation of a photoconductor cycle output pattern, a sleeve cycle output pattern, and a superimposed output pattern for a developing bias Vb and time according to an embodiment.

FIG. 12 is a graph illustrating an example of a relation of the photoconductor cycle output pattern, the sleeve cycle output pattern, and a superimposed output pattern for the developing bias Vb and time. In FIG. 12, the photoconductor cycle output pattern shows an output pattern of the developing bias Vb according to the photoconductor cycle output pattern data. In addition, the sleeve cycle output pattern shows an output pattern of the developing bias Vb according to the sleeve cycle output pattern data. In addition, the superimposed output pattern shows an output pattern of the developing bias obtained by superimposing the two output patterns. In addition, the developing bias output pattern shows a variation pattern of the developing bias Vb actually output from the developing power supply.

As illustrated in FIG. 12, in spite of the fact that the developing bias output pattern needs to be the same pattern as the superimposed output pattern originally, the developing bias output pattern is set to a pattern in which all of values larger than −800 [V] are replaced with −800 [V]. When the values larger than −800 [V] are replaced with −800 [V], occurrence of the image density unevenness cannot be suppressed.

The developing bias reference value is affected greatly by an environment variation. In a low temperature/humidity environment, the toner in the developing device is easy to be frictionally charged and a charging amount Q/M of the toner becomes a relatively large value. In addition, in a developer, because electrostatic adhesion force of toner particles for magnetic carrier particles becomes relatively strong, developing performance is degraded. In this state, if the process control process to be a reference value correction process is executed, the developing bias reference value is set to a relatively large value to obtain a desired toner adhesion amount with the degraded developing performance. Thereby, the present inventors conduct experiments and find that a part of a waveform of the superimposed output pattern is beyond the output upper limit of the developing power supply.

Next, a characteristic configuration of the image forming apparatus 1 will be described. The controller 110 executes a determination process to determine propriety of the superimposed output pattern (output range) and a data process for a shift to shift a position of the superimposed output pattern to a high potential side or the low potential side, if necessary, for each color of Y, C, M, and K.

Figure 13:
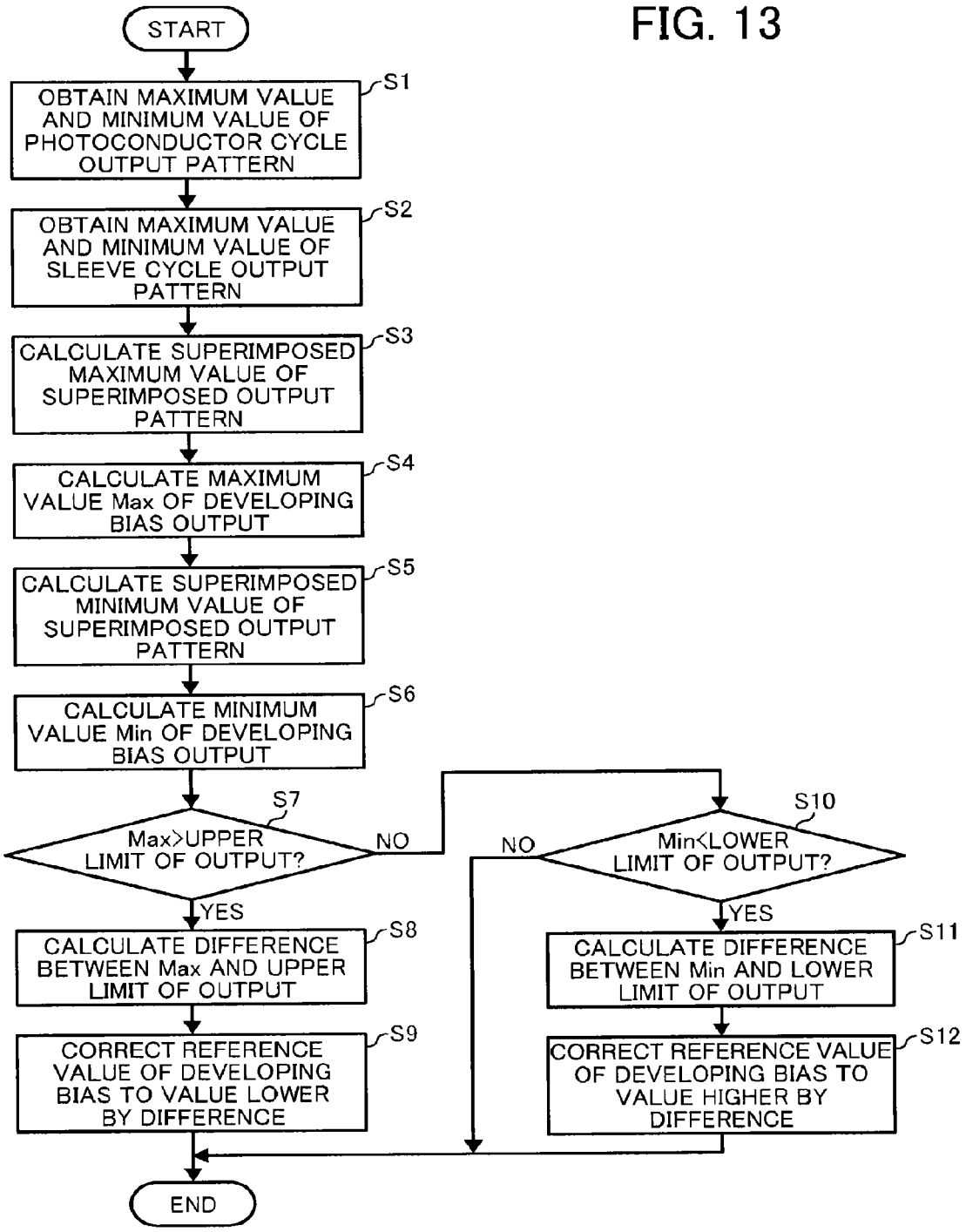
FIG. 13 is a flowchart illustrating a process flow in a determination/correction process executed by a controller of the image forming apparatus according to an embodiment.

FIG. 13 is a flowchart illustrating a process flow in the determination/shift process executed by the controller 110. The determination/shift process is a combination process of the determination process and the data process for the shift and is executed by all means immediately after the developing bias reference values for Y, C, M, and K are determined by the process control process, respectively. If the determination/shift process starts, the controller 110 executes the process flow illustrated in FIG. 13, for each color.

Specifically, first, after a maximum value and a minimum value of the photoconductor cycle output pattern stored in the non-volatile memory are specified (step 1: hereinafter, step is represented as S), a maximum value and a minimum value of the sleeve cycle output pattern are specified (S2). The photoconductor rotation cycle and the sleeve rotation cycle are different from each other and the photoconductor rotation cycle is longer than the sleeve rotation cycle. For this reason, sleeve cycle output patterns of a plurality of rounds are superimposed on the photoconductor cycle output pattern. In addition, a phase in which a sleeve cycle output pattern group is superimposed on a photoconductor cycle output pattern corresponding to one cycle is different for each cycle of the photoconductor. In the course of rotating the photoconductor over a plurality of rounds, a maximum value of the sleeve cycle output pattern may be superimposed on a maximum value of the photoconductor cycle output pattern. In addition, a minimum value of the sleeve cycle output pattern may be superimposed on a minimum value of the photoconductor cycle output pattern. For this reason, a maximum value of a superimposed output pattern obtained by superimposing two cycle output patterns becomes a value obtained by adding the maximum value of the photoconductor cycle output pattern and the maximum value of the sleeve cycle output pattern. In addition, a minimum value of a superimposed output pattern obtained by superimposing two cycle output patterns becomes a value obtained by adding the minimum value of the photoconductor cycle output pattern and the minimum value of the sleeve cycle output pattern.

Therefore, the controller 110 calculates a superimposed maximum value to be the maximum value of the superimposed output pattern by adding the maximum value of the photoconductor cycle output pattern data and the maximum value of the sleeve cycle output pattern data (S3). In addition, the controller 110 calculates a developing bias output maximum value Max by adding the superimposed maximum value to the developing bias reference value (S4). In addition, the controller 110 calculates a superimposed minimum value to be the minimum value of the superimposed output pattern by adding the minimum value of the photoconductor cycle output pattern data and the minimum value of the sleeve cycle output pattern data (S5). In addition, the controller 110 calculates a developing bias output minimum value Min by adding the superimposed minimum value to the developing bias reference value (S6). Next, the controller 110 determines whether the developing bias output maximum value Max is greater than the output upper limit of the developing power supply (S7). When the developing bias output maximum value is greater than the output upper limit (YES in S7), the controller 110 calculates a difference between the developing bias output maximum value Max and the output upper limit of the developing power supply (S8), corrects the developing bias reference value with a value smaller than the developing bias reference value by the same value as the difference (S9), and ends the process flow. By correction, the image density of the entire image is lower than a target image density. However, the developing bias output maximum value becomes the same value as the output upper limit of the developing power supply. For this reason, the superimposed output pattern can be generated with a correct pattern. Therefore, occurrence of image density unevenness in a page can be surely suppressed.

Meanwhile, in S7, when the developing bias output maximum value is not beyond the output upper limit of the developing power supply (NO in S7), the controller 110 determines whether the developing bias output minimum value Min is lower than the output lower limit of the developing power supply (S10). When the developing bias output minimum value Min is lower than the output lower limit (YES in S10), the controller 110 calculates a difference between the developing bias output minimum value Min and the output lower limit of the developing power supply (S11), the controller 110 corrects the developing bias reference value with a value larger than the developing bias reference value by the same value as the difference (S12), and ends the process flow. By correction, the image density of the entire image is higher than a target image density. However, the developing bias output minimum value becomes the same value as the output lower limit of the developing power supply. For this reason, the superimposed output pattern can be generated with a correct pattern. Therefore, occurrence of image density unevenness in a page can be surely suppressed. At this time, the charging bias Vd and the LD power are set to appropriate values to maintain a predetermined image density.

In S10, when the developing bias output minimum value Min is not lower than the output lower limit (NO in S10), the controller 110 ends the process flow.

The controller 110 executes the determination/shift process individually for each color of Y, C, M, and K. As a result, when the output maximum value of the developing bias output pattern according to the developing bias reference value and the superimposed output pattern is beyond the output upper limit of the developing power supply, the controller 110 corrects the developing bias reference value with a value not beyond the output upper limit. When the output minimum value of the developing bias output pattern is below the output lower limit of the developing power supply, the controller 110 corrects the developing bias reference value with a value not below the output lower limit. By correction, the developing bias Vb is changed by the developing bias output pattern of the same pattern as the superimposed output pattern, regardless of the output upper limit and the output lower limit, so that occurrence of image density unevenness in a page can be surely suppressed.

The configuration in which the output value of the developing bias Vb is changed according to the superimposed output pattern according to the developing bias reference value has been described. However, the output value may be changed as follows. That is, the output value of the developing bias Vb is changed according to the photoconductor cycle output pattern or the sleeve cycle output pattern, not the superimposed output pattern. In the case of this configuration, only the photoconductor rotation sensors (76Y, 76M, 76C, and 76K) necessary for constructing the photoconductor cycle output pattern or the sleeve rotation sensors (83Y, 83M, 83C, and 83K) necessary for constructing the sleeve cycle output patterns may be provided.

The construction process executed at the initial start timing has been described. However, in the construction process executed immediately after the replacement of the imaging unit is detected, the construction process is executed for only a color for which the replacement is detected.

The process control process may be executed at regular timing such as whenever predetermined time passes and whenever a predetermined number of pages are printed, in addition to the initial start timing and the replacement detection timing. In addition, the determination/shift process is executed by all means after the process control process executed at the regular timing.

Next, an image forming apparatus according to a variation form in which a partial configuration of the image forming apparatus according to the above-described embodiment is varied with other configuration will be described. A configuration of the image forming apparatus according to the variation form is the same as the configuration according to the above-described embodiment unless specified. In an image in which a solid portion and a halftone portion are mixed, an image density of the solid portion is affected greatly by a developing potential to be a difference of a developing bias Vb and a latent image potential Vl to be a potential of an electrostatic latent image. Meanwhile, an image density of the halftone portion may be affected greatly by a background potential to be a difference of a background portion potential Vd and the developing bias Vb of the photoconductor rather than the developing potential. The reason is as follows. In the solid portion, peripheral portions of all dots are superimposed on peripheral portions of dots adjacent to the individual dots. That is, there is no isolated dot. Meanwhile, in the halftone portion, there is an isolated dot or there is a small dot group including a set of small dots. The isolated dot or the small dot group is affected greatly by an edge effect more than the solid portion. For this reason, under a condition of the same background potential as the solid portion, adhesion force of the halftone portion on the photoconductor is stronger than adhesion force of the solid portion and the halftone portion is hard to be affected by a gap variation as compared with the solid portion. A toner adhesion amount of the halftone portion per unit area is larger than a toner adhesion amount of the solid portion and a toner adhesion amount variation amount by the gap variation in the halftone portion decreases as compared with a toner adhesion amount variation amount in solid. As a result, as in the image forming apparatus according to the above-described embodiment, if the developing bias Vb is changed by a superimposed output pattern constructed according to a toner image for density unevenness detection including a solid toner image, occurrence of the image density unevenness can be suppressed for the solid portion. However, overcorrection is executed in the halftone portion. In addition, the image density unevenness may occur in the halftone portion, due to the overcorrection.

Because the edge effect is affected greatly by the background potential, the overcorrection can be modified by adjusting the background potential. When the background potential is changed, the background portion potential Vd may be changed by changing the charging bias. As such, even though the background portion potential Vd is changed, the developing potential can be maintained approximately constant. For example, under of the normal background portion potential Vd=−1100 [V], the developing bias Vb=−700 [V], and the latent image potential Vl=−50 [V], the background portion potential Vd is changed to −1000 [V] or −1200 [V], if necessary. If the latent-image writing intensity is set to a value in which a saturation exposure potential of about −50 [V] is obtained even though the background portion potential is changed as described above, the latent image potential Vl can be maintained to approximately −50 [V] regardless of the background portion potential Vd. For this reason, even though the background potential is changed by changing the background portion potential Vd, the developing potential Vp can be maintained constant. Therefore, the developing potential does not affect the image density of the solid portion.

Figure 14:
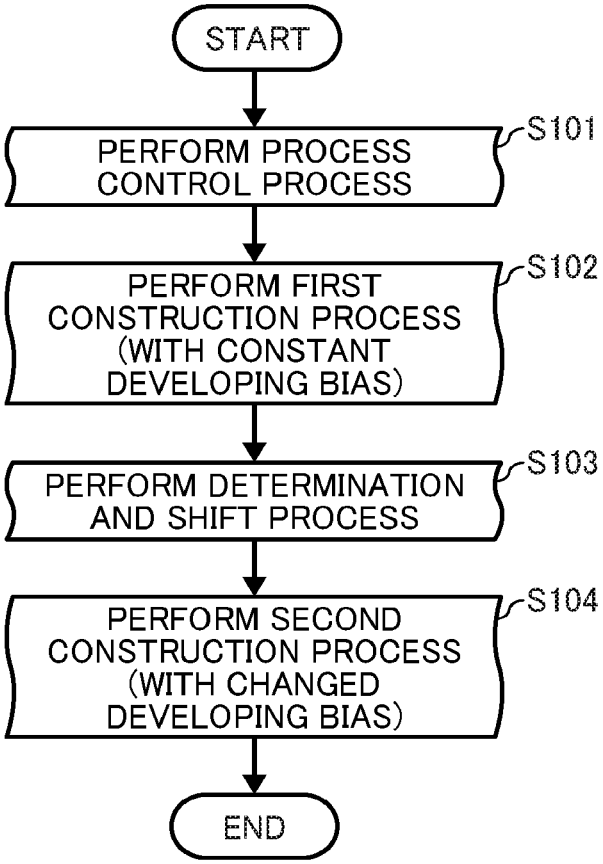
FIG. 14 is a flowchart illustrating a process flow of a process executed at initial start timing in an image forming apparatus according to a variation form.

FIG. 14 is a flowchart illustrating a process flow of a process executed at the initial start timing, in the image forming apparatus according to the variation form. In this process, first, the controller 110 executes a process control process (S101). In addition, the controller 110 executes a first construction process as the construction process and constructs photoconductor cycle output pattern data or sleeve cycle output pattern data for the developing bias to suppress occurrence of the image density unevenness of the solid portion of the image (S102). At this time, a toner image for density unevenness detection for each color is formed under the developing bias Vb of the same value as the developing bias reference value determined by the immediately previous process control process. Next, the controller 110 executes a determination/shift process to determine propriety of the developing bias reference value or correct the developing bias reference value, according to a maximum value and a minimum value of the constructed photoconductor cycle output pattern data and a maximum value and a minimum value of the constructed sleeve cycle output pattern data (S103). At this time, the charging bias is also shifted by the same value as the developing bias to maintain the density of the halftone.

Then, the controller 110 executes a second construction process (S4) and constructs the photoconductor cycle output pattern data or the sleeve cycle output pattern data for the charging bias to suppress occurrence of the image density unevenness of the halftone portion of the image.

Specific process content of the second construction process (S4) is as follows. First, a toner image for Y density unevenness detection including a Y halftone toner image is formed on the photoconductor 20Y. In addition, a toner image for C density unevenness detection including a C halftone toner image, a toner image for M density unevenness detection including an M halftone toner image, and a toner image for K density unevenness detection including a K halftone toner image are formed on the photoconductor 20C, the photoconductor 20M, and the photoconductor 20K, respectively. At the time of forming the images, the developing bias Vb for each of Y, C, M, and K is changed according to the developing bias reference value, the photoconductor cycle output pattern, the photoconductor reference position timing, the sleeve cycle output pattern, and the sleeve reference position timing corresponding to each of Y, C, M, and K. Under these conditions, the image density unevenness of the photoconductor rotation cycle or the sleeve rotation cycle does not occur in the solid portion. However, because the four toner images for the density unevenness detection include the halftone toner images, the image density unevenness occurs due to the overcorrection of the developing bias Vb. The controller 110 executes sampling of outputs from the four reflective photosensors of the optical sensor unit 150 at a predetermined time interval over time equal to or longer than one cycle of the photoconductor, to detect the image density unevenness.

Then, the controller 110 extracts a density unevenness pattern occurring with the photoconductor rotation cycle, according to sampling data obtained for each color. After a toner adhesion amount average value (image density average value) is calculated by integration of a variation waveform, the controller 110 constructs the photoconductor cycle output pattern data of the charging bias to offset the density unevenness pattern of the rotation cycle of the photoconductor, according to the toner adhesion amount average value. Specifically, the controller 110 calculates bias output differences corresponding to a plurality of toner adhesion amount data included in the density pattern. The bias output difference is based on the toner adhesion amount average value. The bias output difference corresponding to the toner adhesion amount data having the same value as the toner adhesion amount average value is calculated as zero. In addition, the bias output difference corresponding to the toner adhesion amount data having a value larger than the toner adhesion amount average value is calculated as a value of a positive polarity according to a difference of the toner adhesion amount and the toner adhesion amount average value. Because the bias output difference is the bias output difference of the positive polarity, the bias output difference is data to change a developing bias of a positive polarity as a value (value having a small absolute value) smaller than the developing bias reference value. In addition, the bias output difference corresponding to the toner adhesion amount data having a value smaller than the toner adhesion amount average value is calculated as a value of a negative polarity according to a difference of the toner adhesion amount and the toner adhesion amount average value. Because the bias output difference is the bias output difference of the negative polarity, the bias output difference is data to change a developing bias of a negative polarity as a value (value having a large absolute value) larger than the developing bias reference value.

In this way, the bias output differences corresponding to the individual toner adhesion amounts are calculated and data in which the bias output differences are arranged sequentially is constructed as the photoconductor cycle output pattern data for the charging bias.

Next, after the controller 110 extracts the density unevenness pattern occurring with the rotation cycle of the developing sleeve, according to the sampling data, for each color, the controller 110 calculates a toner adhesion amount average value (image density average value). In addition, the controller 110 constructs the sleeve cycle output pattern data for the charging bias to offset the density unevenness pattern of the rotation cycle of the developing sleeve, according to the toner adhesion amount average value. A specific method is the same as a method of constructing the photoconductor cycle output pattern data to offset the density unevenness pattern of the rotation cycle of the photoconductor.

In this way, if the photoconductor cycle output pattern data or the sleeve cycle output pattern data for the charging bias is constructed, order of individual data included in the pattern data is shifted by a predetermined number. Specifically, leading data in the photoconductor cycle output pattern data corresponds to a place entering the developing region when the photoconductor takes the reference rotation position, in an entire region of the circumferential face of the photoconductor. The place is not charged in the developing region and is charged in a contact region of the charging rollers (71Y, 71C, 71M, and 71K) and the photoconductors (20Y, 20C, 20M, and 20K). Because there is a time lag during movement from the contact region to the developing region, the position of each data is shifted by a number corresponding to the time lag. For example, in the case of pattern data including 250 data, a position of each of first to two-hundred thirtieth data is shifted backward by 20 and two-hundred thirty-first to two-hundred fiftieth data are changed to first to twentieth data. Likewise, in the sleeve cycle output pattern data, positions of a variety of data are shifted by a predetermined number.

When an image based on a command from a user is formed, the output of the developing bias Vb from the developing power supply is changed according to the photoconductor cycle output pattern data or the sleeve cycle output pattern data for the developing bias constructed by the first construction process, for each color. Specifically, the superimposed output pattern data is constructed according to the photoconductor cycle output pattern data, the photoconductor reference position timing, the sleeve cycle output pattern data, and the sleeve reference position timing. In addition, the output value of the developing bias Vb is changed according to the superimposed output pattern data and the developing bias reference value. As a result, the image density unevenness of the solid portion occurring with the photoconductor rotation cycle or the sleeve rotation cycle can be suppressed.

In addition, when an image based on a command from the user is formed, the output of the charging bias from the charging power supply is changed according to the photoconductor cycle output pattern data or the sleeve cycle output pattern data constructed by the second construction process, for each color. Specifically, the superimposed output pattern data is constructed according to the photoconductor cycle output pattern data, the photoconductor reference position timing, the sleeve cycle output pattern data, and the sleeve reference position timing. In addition, the output value of the charging bias from the charging power supply is changed according to the superimposed output pattern data and the charging bias reference value to be the reference value determined by the process control process. As a result, the image density unevenness of the halftone portion occurring with the photoconductor rotation cycle or the sleeve rotation cycle due to the overcorrection of the developing bias Vb can be suppressed.

As the developing bias reference value when the image based on the command from the user is formed, the value determined by the process control process may be used without correction. That is, only the developing bias reference value used for the second construction process may be corrected by the determination/correction process.

Next, an image forming apparatus according to each variation in which the partial configuration of the image forming apparatus according to the above-described variation form is varied with other configuration will be described. A configuration of the image forming apparatus according to each variation is the same as the configuration according to the variation form, as long as a special mention is not given.

[First Variation]

In an image forming apparatus according to a first variation, the determination/shift process is not executed. Instead, the following correction process is executed according to predetermined conditions being met. That is, the correction process is a correction process to correct the target toner adhesion amount referred to when the developing bias reference value is determined by the process control process to be the reference value determination process or the developing bias reference value determined by the process control process, the charging bias reference value, and the LD power.

As the predetermined conditions, three conditions of a condition of a low temperature/humidity environment, a condition of a high temperature/humidity environment, and a condition where the developing bias reference value or the charging bias reference value calculated by the process control process is in a predetermined range are adopted. In the case of the low temperature/humidity environment, a toner charging amount Q/M becomes a relatively large value and developing performance is degraded. For this reason, the developing bias reference value or the charging bias reference value determined by the process control process becomes a relatively large value. As a result, a part in an output range of the developing bias Vb is easy to be beyond the upper limit of the developing power supply. In addition, a part in an output range of the charging bias Vd is easy to be beyond the upper limit of the charging power supply. Therefore, when the low temperature/humidity environment is detected by an environment sensor not illustrated in the drawings, the controller 110 corrects the target toner adhesion amount referred to in the process control process, for example, from 0.40 [mg/cm2] to be a standard amount to 0.35 [mg/cm2]. The developing bias reference value or the charging bias reference value is determined as a smaller value by the correction, so that the output range of the developing bias Vb can be set to be below the output upper limit of the developing power supply. In addition, the output range of the charging bias Vd can be set to be below the output upper limit of the charging power supply. In addition, the developing bias Vb can be surely changed by the second construction process according to the output patter data.

When the high temperature/humidity environment is detected by an environment sensor not illustrated in the drawings, the controller 110 corrects the target toner adhesion amount referred to in the process control process, for example, from 0.40 [mg/cm2] to be the standard amount to 0.45 [mg/cm2]. The developing bias reference value or the charging bias reference value is determined as a larger value by the correction, so that the output range of the developing bias can be set not to be below the output lower limit of the developing power supply. In addition, the output range of the charging bias can be set not to be below the output lower limit of the charging power supply. In addition, the developing bias reference value or the charging bias reference value may be corrected, instead of correcting the target toner adhesion amount.

When the developing bias reference value calculated by the process control process is in a predetermined range, a part of a change range of the developing bias Vb according to the output pattern data is easy to be beyond the output upper limit of the developing power supply or below the output lower limit. For example, if a difference of the developing bias reference value and the output upper limit of the developing power supply becomes a value of 20 [V] or less, the part of the change range of the developing bias Vb according to the output pattern data is easy to be beyond the output upper limit of the developing power supply. In addition, if a difference of the developing bias reference value and the output lower limit of the developing power supply becomes a value of 20 [V] or less, the part of the change range of the developing bias Vb according to the output pattern data is easy to be below the output lower limit of the developing power supply. Likewise, if the charging bias reference value is in a predetermined range, a part of a change range of the charging bias Vd according to the output pattern data is easy to be beyond the output upper limit of the charging power supply or below the output lower limit.

Therefore, when the developing bias reference value calculated by the process control process is in the predetermined range (range of large values), the target toner adhesion amount is corrected, for example, from 0.40 [mg/cm2] to be the standard amount to 0.35 [mg/cm2] and the developing bias reference value is determined again. The developing bias reference value is determined as a smaller value by the correction, so that the output range of the developing bias Vb can be set to be below the output upper limit of the developing power supply. In addition, when the charging bias reference value calculated by the process control process is in the predetermined range (range of large values), the target toner adhesion amount is corrected, for example, from 0.40 [mg/cm2] to be the standard amount to 0.35 [mg/cm2] and the developing bias reference value is determined again. The charging bias reference value is determined as a smaller value by the correction, so that the output range of the charging bias Vd can be set to be below the output upper limit of the charging power supply.

When the developing bias reference value calculated by the process control process is in the predetermined range (range of small values), the target toner adhesion amount is corrected, for example, from 0.40 [mg/cm2] to be the standard amount to 0.45 [mg/cm2] and the developing bias reference value is determined again. The developing bias reference value is determined as a larger value by the correction, so that the output range of the developing bias Vb can be set to be beyond the output lower limit of the developing power supply. Even when the charging bias reference value calculated by the process control process is in the predetermined range (range of large values), the target toner adhesion amount is corrected, for example, from 0.40 [mg/cm2] to be the standard amount to 0.40 [mg/cm2] and the developing bias reference value is determined again. The charging bias reference value is determined as a larger value by the correction, so that the output range of the charging bias Vd can be set to be beyond the output lower limit of the charging power supply.

When the developing bias reference value or the charging bias reference value is determined again, the reference value may be calculated from the relation of the developing performance (developing $\gamma$) and the target toner adhesion amount by an operation. A developing potential Vp in which a new target toner adhesion amount is obtained is calculated according to the characteristic diagram of FIG. 10 obtained by the immediately previous process control process. At this time, the LD power may be appropriately set according to a previously designed table or expression. Instead of calculating the new reference value by the operation as described above, the process may be executed again from the process control process. In addition, 20 [V] is exemplified as the predetermined range. However, the predetermined range is not limited to the above value.

As described above, the construction process and the print are executed in a state in which the bias output range is set as the output upper/lower limit range of the power supply.

[Second Variation]

In an image forming apparatus according to a second variation, the determination/shift process is executed. Instead, in the process control process, the developing bias reference value is determined as a value in a range from a predetermined lower limit (hereinafter, referred to as a developing reference value lower limit) to an upper limit (hereinafter, referred to as a developing reference value upper limit). Even when the developing bias reference value needs to be set to a value beyond the developing reference value upper limit to obtain the target toner adhesion amount, the developing bias reference value is set to the same value as the developing reference value upper limit, not the value beyond the developing reference value upper limit. Even when the developing bias reference value needs to be set to a value below the developing reference value lower limit to obtain the target toner adhesion amount, the developing bias reference value is set to the same value as the developing reference value lower limit, not the value below the developing reference value lower limit.

For the developing reference value upper limit, even when the developing bias reference value is set to the developing reference value upper limit, an output range is set to a value not higher than the output upper limit according to amplitude of an output pattern of a developing bias Vb measured by experiments in advance and an output upper limit of the developing power supply. In addition, for the developing reference value lower limit, even when the developing bias reference value is set to the developing reference value lower limit, an output range is set to a value not lower than the output lower limit according to the amplitude of the output pattern of the developing bias Vb and an output lower limit of the developing power supply. For this reason, a maximum value of a change range of the developing bias Vb output from the developing power supply according to the output pattern data can be surely set to the value not higher than the output upper limit of the developing power supply and a minimum value of the change range can be surely set to the value not lower than the output lower limit of the developing power supply. As a result, the developing bias Vb can be surely changed by a pattern according to the output pattern data, regardless of the output upper limit and the output lower limit of the charging power supply, and occurrence of image density unevenness in a page can be surely suppressed.

In addition, in the process control process, the image forming apparatus according to the second variation determines a charging bias reference value to be a value in a range from the predetermined lower limit (hereinafter, referred to as a charging reference value lower limit) to an upper limit (hereinafter, referred to as a charging reference value upper limit). Even when the charging bias reference value needs to be set to a value beyond the charging reference value upper limit to obtain the target toner adhesion amount, the charging bias reference value is set to the same value as the charging reference value upper limit, not the value beyond the charging reference value upper limit. Even when the charging bias reference value needs to be set to a value below the charging reference value lower limit to obtain the target toner adhesion amount, the charging bias reference value is set to the same value as the charging reference value lower limit, not the value below the charging reference value lower limit.

For the charging reference value upper limit, even when the charging bias reference value is set to the charging reference value upper limit, an output range is set to a value not higher than the output upper limit according to amplitude of an output pattern of a charging bias Vd measured by experiments in advance and an output upper limit of the charging power supply. In addition, for the charging reference value lower limit, even when the charging bias reference value is set to the charging reference value lower limit, an output range is set to a value not lower than the output lower limit according to the amplitude of the output pattern of the charging bias Vd and an output lower limit of the charging power supply. For this reason, a maximum value of a change range of the charging bias Vd output from the charging power supply according to the output pattern data can be surely set to the value not higher than the output upper limit of the charging power supply and a minimum value of the change range can be surely set to the value not lower than the output lower limit of the charging power supply. As a result, the charging bias Vd can be surely changed by a pattern according to the output pattern data, regardless of the output upper limit and the output lower limit of the charging power supply, and occurrence of image density unevenness in a page can be surely suppressed.

An application of the present disclosure is not limited to the image forming apparatus illustrated as the copiers according to the above-described embodiment, the variation form, the first variation, and the second variation and various variations or changes can be made. For example, as the image forming apparatus to which the present disclosure can be applied, a printer, a facsimile, and a multifunction peripheral can be exemplified, instead of the copier. In addition, the present disclosure can be applied to a monochrome image forming apparatus to form only a monochrome image, not an image forming apparatus to form a color image. In addition, the present disclosure can be applied to an image forming apparatus having a configuration in which an image is formed on both sides of a recording sheet according to necessity, not a configuration in which an image is formed on only a single side of the recording sheet. As the recording sheet, plain paper, an overhead projector (OHP) sheet, a card, a postcard, thick paper, and an envelope can be exemplified.

The content described above is exemplary and the present disclosure achieves a particular effect for each of the following aspects.

[Aspect A]

An image forming apparatus includes an imaging device (for example, a combination of imaging units 18Y, 18C, 18M, and 18K and a laser writer 21) that forms a toner image on a moving surface of an image bearer; a transferer (for example, a transfer unit) that transfers the toner image on the image bearer to a recording sheet directly or via an intermediate transferer; a rotator (for example, photoconductors 20Y, 20C, 20M, and 20K or developing sleeves 81Y, 81C, 81M, and 81K) that is rotatable; a rotation position sensor (for example, photoconductor rotation sensors 76Y, 76C, 76M, and 76K or sleeve rotation sensors 83Y, 83C, 83M, and 83K) that detects a rotation position of the rotator; an adhesion amount sensor (for example, an optical sensor unit 150) that detects a toner adhesion amount of the toner image formed by the imaging device; a power supply (for example, developing power supplies 11Y, 11C, 11M, and 11K or charging power supplies 12Y, 12C, 12M, and 12K) that outputs a voltage contributing to a predetermined process in the course from formation to transfer of the toner image; and a controller (for example, a controller 110) that executes a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor when the toner image for the density unevenness detection is formed, and an output change process to execute the process while changing the voltage output from the power supply, according to the detection result from the rotation position sensor and the output pattern data. The controller executes a determination process to determine propriety of an output range of the voltage output from the power supply by the output change process and a data process for a shift to shift the output range when a determination result is inappropriate in the determination process.

In such a configuration, in the determination process, the propriety of the output range of the voltage output from the power supply is determined according to the output pattern data. For example, when a maximum value and a minimum value of the output range are used as a determination reference and the maximum value is beyond an output upper limit of the power supply or the minimum value is below an output lower limit of the power supply, it is determined that the output range is inappropriate. In addition, the data process for the shift is executed and the output range is shifted. Specifically, when the maximum value of the output range is beyond the output upper limit of the power supply, the data process to shift the output range to decrease the output value is executed. In addition, when the minimum value of the output range is below the output lower limit of the power supply, the data process to shift the output range to increase the output value is executed. In both cases, if the output range is shifted, an average value of the developing potential is changed and an image density of an entire image may be shifted from a target density. However, for the output of the voltage, a change according faithfully to the output pattern can be generated. As a result, image density unevenness in a page occurring with the rotation cycle of the rotator can be surely suppressed, regardless of the output upper limit and the output lower limit of the power supply.

[Aspect B]

In the image forming apparatus according to aspect A, the imaging device has a latent image bearer (for example, photoconductors 20Y, 20C, 20M, and 20K) to be the image bearer, a charger (for example, charging devices 70Y, 70C, 70M, and 70K) to charge the latent image bearer, a latent image writer (for example, a laser writer 21) to write a latent image to the latent image bearer after charging, and a developing unit (for example, developing devices 80Y, 80C, 80M, and 80K) to develop the latent image using a developer borne by a developer bearer and the power supply is a charging power supply (for example, charging power supplies 12Y, 12C, 12M, and 12K) to output a charging bias supplied to the charger, an internal power supply circuit mounted on the latent image writer to change latent-image writing intensity, a developing power supply (for example, developing power supplies 11Y, 11C, 11M, and 11K) to output a developing bias supplied to the developer bearer, or a transfer power supply to output a transfer bias supplied to the transferer. In such a configuration, the output from the charging power supply, the internal power supply circuit, the developing power supply, or the transfer power supply is changed, so that the image density unevenness occurring with the rotation cycle of the rotator can be suppressed.

[Aspect C]

In the image forming apparatus according to aspect B, the controller executes a reference value determination process to determine a reference value of the charging bias, an output from the internal power supply circuit, the developing bias, or the transfer bias at predetermined timing, according to a result obtained by detecting toner adhesion amounts of a plurality of toner images for toner adhesion amount detection formed by the imaging device under different image formation conditions by the adhesion amount sensor and the image formation conditions corresponding to the toner images for the toner adhesion amount detection. In such a configuration, the reference value determination process is executed regularly, so that an image density of an entire image can be stabilized over a long period.

[Aspect D]

In the image forming apparatus according to aspect C, the controller changes a voltage output from the charging power supply, the internal power supply circuit, the developing power supply, or the transfer power supply according to the reference value and the output pattern data, by the output change process, determine propriety of the output range according to the reference value and the output pattern data, by the determination process, and shift the output range by correction of the reference value, by the data process for the shift. In such a configuration, the output range of the voltage output by the output change process can be easily shifted by a simple process such as correction of the reference value.

[Aspect E]

In the image forming apparatus according to aspect C or D, the controller forms a toner image including an entire solid toner image as the toner image for the density unevenness detection, under a condition where each of an output from the internal power supply circuit and an output from the developing power supply is set constant, and construct output pattern data for solid density stabilization to change the output of one of the internal power supply circuit and the developing power supply to stabilize an image density in a solid portion of an image as the output pattern data, according to a toner adhesion amount of the entire solid toner image, by the construction process. In such a configuration, the latent-image writing intensity or the developing bias is changed according to the output pattern data, so that the image density unevenness occurring with the rotation cycle of the rotator in the solid portion of the image can be suppressed.

[Aspect F]

In the image forming apparatus according to aspect E, the controller determines propriety of the reference value of the voltage output from one of the internal power supply circuit and the developing power supply, according to the output pattern data for the solid density stabilization, by the determination process, after the construction process is executed. In such a configuration, propriety of the output range from the internal power supply circuit or the developing power supply can be determined by the determination process.

[Aspect G]

In the image forming apparatus according to aspect F, the controller sequentially executes a first construction process to be the construction process to construct the output pattern data for the solid density stabilization and the determination process and execute a second construction process to form a toner image including a halftone toner image as the toner image for the density unevenness detection while changing the output from one of the internal power supply circuit and the developing power supply according to the output pattern data for the solid density stabilization and construct output pattern data for halftone stabilization to change the output from the charging power supply to stabilize an image density in a halftone portion of an image as the output pattern data, according to a toner adhesion amount of the halftone toner image, after executing the data process for the shift to correct the reference value of the voltage output from one of the internal power supply circuit and the developing power supply according to necessity. In such a configuration, in the second construction process, pattern data capable of offsetting halftone density unevenness occurring due to overcorrection of the latent-image writing intensity or the developing bias can be constructed as the output pattern data for the halftone stabilization.

[Aspect H]

In the image forming apparatus according to aspect G, the controller executes the determination process to determine propriety of the reference value of the voltage output from the charging power supply, according to the output pattern data for the halftone stabilization, after the second construction process is executed. In such a configuration, the reference value of the charging bias is corrected and the output of the charging bias is changed according faithfully to the output pattern data for the halftone stabilization, so that image density unevenness of a halftone portion of an image can be suppressed, regardless of the output upper limit and the output lower limit of the charging power supply.

[Aspect I]

In the image forming apparatus according to aspect H, the controller changes the output from the charging power supply according to the output pattern data for the halftone stabilization while changing the output from one of the internal power supply circuit and the developing power supply according to the output pattern data for the solid density stabilization, by the output change process when an image based on a command from a user is formed. In such a configuration, the output of the charging bias is changed according faithfully to the output pattern data for the halftone stabilization, so that image density unevenness of a halftone portion of an image can be suppressed.

[Aspect J]

In the image forming apparatus according to aspect I, a sensor to detect a rotation position of the latent image bearer to be the rotator is used as the rotation position sensor.

[Aspect K]

In the image forming apparatus according to aspect J, a second rotation position sensor (for example, sleeve rotation sensors 83Y, 83C, 83M, and 83K) to detect a rotation position of the developer bearer to be the rotator is provided in addition to a first rotation position sensor (for example, photoconductor rotation sensors 76Y, 76C, 76M, and 76K) to be the rotation position sensor.

[Aspect L]

In the image forming apparatus according to aspect K, the controller constructs first output pattern data (for example, photoconductor cycle output pattern data for a developing bias) to be the output pattern data for the solid density stabilization, according to an extraction result of image density unevenness occurring with a rotation cycle of the latent image bearer in image density unevenness grasped according to a detection result from the adhesion amount sensor, and construct second output pattern data (for example, sleeve cycle output pattern data for a developing bias) to be the output pattern data for the solid density stabilization, according to an extraction result of image density unevenness occurring with a rotation cycle of the developer bearer, by the first construction process. In such a configuration, the first output pattern data to suppress the image density unevenness in the solid portion of the image occurring with the rotation cycle of the latent image bearer can be constructed. In addition, the second output pattern data to suppress the image density unevenness in the solid portion of the image occurring with the rotation cycle of the developer bearer can be constructed.

[Aspect M]

In the image forming apparatus according to aspect L, the controller determines propriety of the reference value (for example, a developing bias reference value) of the voltage output from one of the internal power supply circuit and the developing power supply, according to the first output pattern data and the second output pattern data, by the determination process executed between the first construction process and the second construction process. In such a configuration, an output range of a superimposed output pattern obtained by superimposing a first output pattern and a second output pattern to be voltage output patterns actually output from the internal power supply circuit or the developing power supply can be easily shifted by correction of the reference value by the output change process.

[Aspect N]

In the image forming apparatus according to aspect M, the controller constructs third output pattern data (for example, photoconductor cycle output pattern data for a charging bias) to be the output pattern data for the halftone stabilization, according to the extraction result of the image density unevenness occurring with the rotation cycle of the latent image bearer in the image density unevenness grasped according to the detection result from the adhesion amount sensor, and construct fourth output pattern data (for example, sleeve cycle output pattern data for a charging bias) to be the output pattern data for the halftone stabilization, according to the extraction result of the image density unevenness occurring with the rotation cycle of the developer bearer, by the second construction process. In such a configuration, the third output pattern data to suppress the image density unevenness in the halftone portion of the image occurring with the rotation cycle of the latent image bearer can be constructed. In addition, the fourth output pattern data to suppress the image density unevenness in the halftone portion of the image occurring with the rotation cycle of the developer bearer can be constructed.

[Aspect O]

In the image forming apparatus according to aspect N, the controller changes the output from one of the internal power supply circuit and the developing power supply, according to the first output pattern data, the detection result from the first rotation position sensor, the second output pattern data, the detection result from the second rotation position sensor, and the reference value of the output from one of the internal power supply circuit and the developing power supply, and change the output from the charging power supply, according to the third output pattern data, the detection result from the first rotation position sensor, the fourth output pattern data, the detection result from the second rotation position sensor, and the reference value of the output from the charging power supply, by the output change process when the image based on the command from the user is formed. In such a configuration, the image density unevenness of the halftone portion of the image occurring with the rotation cycle of the latent image bearer or the rotation cycle of the developer bearer can be suppressed while the image density unevenness of the solid portion of the image occurring with the rotation cycle of the latent image bearer or the rotation cycle of the developer bearer is suppressed.

[Aspect P]

In the image forming apparatus according to any one of aspects I to O, the controller sequentially executes the reference value determination process, the first construction process, the determination process for the reference value of the output from one of the internal power supply circuit and the developing power supply, the data process for the shift when a determination result is inappropriate in the determination process, the second construction process, the determination process for the reference value of the output from the charging power supply, and the data process for the shift when a determination result is inappropriate in the determination process, before a first print job after a factory shipment. In such a configuration, the image density unevenness occurring with the rotation cycle of the rotator can be suppressed, from the first print.

[Aspect Q]

In the image forming apparatus according to any one of aspects I to P, a replacement sensor (for example, unit mount sensors 17Y, 17C, 17M, and 17K) to detect replacement of the imaging device is provided and the controller sequentially executes the reference value determination process, the first construction process, the determination process for the reference value of the output from one of the internal power supply circuit and the developing power supply, the data process for the shift when a determination result is inappropriate in the determination process, the second construction process, the determination process for the reference value of the output from the charging power supply, and the data process for the shift when a determination result is inappropriate in the determination process, before a print job is executed, when the replacement is detected by the replacement sensor. In such a configuration, the rotator is replaced according to the replacement of the imaging device. For this reason, even though the pattern of the image density unevenness occurring with the rotation cycle of the rotator is changed, output pattern data corresponding to a new pattern is constructed before the first print job. As a result, the image density unevenness occurring with the rotation cycle of the rotator can be suppressed from the first print job after the replacement.

[Aspect R]

In the image forming apparatus according to any one of aspects C to Q, the controller executes a combination of the reference value determination process, the determination process, and the data process for the shift at regular timing. In such a configuration, the reference value determination process is executed regularly and an output range of a voltage based on a new reference value is corrected in a range of the output upper limit and the output lower limit while an image density of an entire image is stabilized over a long period. As a result, the image density unevenness can be surely suppressed.

[Aspect S]

In the image forming apparatus according to any one of aspects I to R, the controller is configured not to execute the determination process or the data process for the shift, for the reference value when the image based on the command from the user is formed, and to execute the determination process or the data process for the shift, for the reference value when the second construction process is executed.

[Aspect T]

An image forming apparatus includes an imaging device that forms a toner image on a moving surface of an image bearer; a transferer that transfers the toner image on the image bearer to a recording sheet directly or via an intermediate transferer; a rotator that is rotatable; a rotation position sensor that detects a rotation position of the rotator; an adhesion amount sensor that detects a toner adhesion amount of the toner image formed by the imaging device; a power supply that outputs a voltage contributing to a predetermined process in the course from formation to transfer of the toner image; and a controller that executes a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor when the toner image for the density unevenness detection is formed, an output change process to execute the process while changing the voltage output from the power supply, according to the detection result from the rotation position sensor and the output pattern data, and a reference value determination process to determine a reference value of an output from the power supply, according to a result obtained by detecting toner adhesion amounts of a plurality of toner images for toner adhesion amount detection formed by the imaging device under different imaging conditions by the adhesion amount sensor. The controller executes a correction process to correct a target toner adhesion amount referred to when the reference value is determined by the reference value determination process or the reference value determined by the reference value determination process, according to a predetermined condition being met.

In such a configuration, the target toner adhesion amount or the reference value is corrected according to the predetermined condition being met, for example, a low temperature/humidity environment or execution timing of the second construction process. By the correction, an output maximum value from the power supply is set to a value not higher than the output upper limit and an output minimum value is set to a value not lower than the output lower limit, so that image density unevenness in a page occurring with the rotation cycle of the rotator can be surely suppressed, regardless of the output upper limit and the output lower limit of the power supply.

[Aspect U]

An image forming apparatus includes an imaging device that forms a toner image on a moving surface of an image bearer; a transferer that transfers the toner image on the image bearer to a recording sheet directly or via an intermediate transferer; a rotator that is rotatable; a rotation position sensor that detects a rotation position of the rotator; an adhesion amount sensor that detects a toner adhesion amount of the toner image formed by the imaging device; a power supply that outputs a voltage contributing to a predetermined process in the course from formation to transfer of the toner image; and a controller that executes a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor when the toner image for the density unevenness detection is formed, an output change process to execute the process while changing the voltage output from the power supply, according to the detection result from the rotation position sensor and the output pattern data, and a reference value determination process to determine a reference value of an output from the power supply, according to a result obtained by detecting toner adhesion amounts of a plurality of toner images for toner adhesion amount detection formed by the imaging device under different imaging conditions by the adhesion amount sensor. The controller determines the reference value as a value in a range from a predetermined lower limit to a predetermined upper limit, by the reference value determination process.

In such a configuration, if the upper limit of the reference value determined by the reference value determination process is set to a value significantly smaller than the output upper limit of the power supply and the lower limit of the reference value is set to a value significantly larger than the output lower limit of the power supply, the following effect can be achieved. That is, the maximum value of the change range of the output from the power supply according to the output pattern data can be surely set to a value not higher than the output upper limit of the power supply and the minimum value of the change range can be surely set to a value not lower than the output lower limit of the power supply. As a result, image density unevenness in a page occurring with the rotation cycle of the rotator can be surely suppressed, regardless of the output upper limit and the output lower limit of the power supply.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an imaging device to form a toner image on a moving surface of an image bearer;

a transferer to transfer the toner image on the image bearer to a recording sheet directly or via an intermediate transferer;

a developer bearer that supplies developer to the image bearer;

a rotation position sensor to detect a rotation position of at least one of the image bearer and the developer bearer;

an adhesion amount sensor to detect a toner adhesion amount of the toner image formed by the imaging device;

a power supply to output a voltage contributing to a predetermined process in a course from formation to transfer of the toner image; and a controller to execute a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor obtained when the toner image for the density unevenness detection is formed, and an output change process to execute the predetermined process while changing the voltage output from the power supply, according to the detection result from the rotation position sensor and the output pattern data, the controller executes a determination process to determine propriety of an output range of the voltage output from the power supply by the output change process and a data process for a shift to shift the output range when a maximum developing bias output exceeds an upper limit of the power supply, the maximum developing bias being a sum of a reference value of a charging bias and a superimposed maximum value derived by adding a maximum bias of an image bearer cycle and a maximum bias of a developer bearer cycle.

2. The image forming apparatus according to claim 1, wherein the imaging device includes a latent image bearer to be the image bearer, a charger to charge the latent image bearer, a latent image writer to write a latent image to the latent image bearer after charging, and a developing unit to develop the latent image using the developer borne by the developer bearer, and wherein the power supply is a charging power supply to output a charging bias supplied to the charger, an internal power supply circuit mounted on the latent image writer to change latent-image writing intensity, a developing power supply to output a developing bias supplied to the developer bearer, or a transfer power supply to output a transfer bias supplied to the transferer.

3. The image forming apparatus according to claim 2, wherein the controller is configured to execute a reference value determination process to determine the reference value of the charging bias, an output from the internal power supply circuit, the developing bias, or the transfer bias at predetermined timing, according to a result obtained by detecting toner adhesion amounts of a plurality of toner images for toner adhesion amount detection formed by the imaging device under different image formation conditions by the adhesion amount sensor and the image formation conditions corresponding to the toner images for the toner adhesion amount detection.

4. The image forming apparatus according to claim 3, wherein the controller is configured to change a voltage output from the charging power supply, the internal power supply circuit, the developing power supply, or the transfer power supply according to the reference value and the output pattern data, by the output change process, determine propriety of the output range according to the reference value and the output pattern data, by the determination process, and shift the output range by correction of the reference value, by the data process for the shift.

5. The image forming apparatus according to claim 3, wherein the controller is configured to form a toner image including an entire solid toner image as the toner image for the density unevenness detection, under a condition where each of an output from the internal power supply circuit and an output from the developing power supply is set constant, and construct output pattern data for solid density stabilization to change the output of one of the internal power supply circuit and the developing power supply to stabilize an image density in a solid portion of an image as the output pattern data, according to a toner adhesion amount of the entire solid toner image, by the construction process.

6. The image forming apparatus according to claim 5, wherein the controller is configured to determine propriety of the reference value of the voltage output from one of the internal power supply circuit and the developing power supply, according to the output pattern data for the solid density stabilization, by the determination process, after the construction process is executed.

7. The image forming apparatus according to claim 6, wherein the controller is configured to sequentially execute a first construction process to be the construction process to construct the output pattern data for the solid density stabilization and the determination process and execute a second construction process to form a toner image including a halftone toner image as the toner image for the density unevenness detection while changing the output from one of the internal power supply circuit and the developing power supply according to the output pattern data for the solid density stabilization and construct output pattern data for halftone stabilization to change the output from the charging power supply to stabilize an image density in a halftone portion of an image as the output pattern data, according to a toner adhesion amount of the halftone toner image, after executing the data process for the shift to correct the reference value of the voltage output from one of the internal power supply circuit and the developing power supply according to necessity.

8. The image forming apparatus according to claim 7, wherein the controller is configured to execute the determination process to determine propriety of the reference value of the voltage output from the charging power supply, according to the output pattern data for the halftone stabilization, after the second construction process is executed.

9. The image forming apparatus according to claim 8, wherein the controller is configured to change the output from the charging power supply according to the output pattern data for the halftone stabilization while changing the output from one of the internal power supply circuit and the developing power supply according to the output pattern data for the solid density stabilization, by the output change process when an image based on a command from a user is formed.

10. The image forming apparatus according to claim 9, wherein the rotation position sensor is configured to detect a rotation position of the latent image bearer.

11. The image forming apparatus according to claim 10, further comprising a second rotation position sensor to detect a rotation position of the developer bearer in addition to a first rotation position sensor serving as the rotation position sensor.

12. The image forming apparatus according to claim 11, wherein the controller is configured to construct first output pattern data to be the output pattern data for the solid density stabilization, according to an extraction result of image density unevenness occurring with a rotation cycle of the latent image bearer in image density unevenness grasped according to a detection result from the adhesion amount sensor, and construct second output pattern data to be the output pattern data for the solid density stabilization, according to an extraction result of image density unevenness occurring with a rotation cycle of the developer bearer, by the first construction process.

13. The image forming apparatus according to claim 12, wherein the controller is configured to determine propriety of the reference value of the voltage output from one of the internal power supply circuit and the developing power supply, according to the first output pattern data and the second output pattern data, by the determination process executed between the first construction process and the second construction process.

14. The image forming apparatus according to claim 13, wherein the controller is configured to construct third output pattern data to be the output pattern data for the halftone stabilization, according to the extraction result of the image density unevenness occurring with the rotation cycle of the latent image bearer in the image density unevenness grasped according to the detection result from the adhesion amount sensor, and construct fourth output pattern data to be the output pattern data for the halftone stabilization, according to the extraction result of the image density unevenness occurring with the rotation cycle of the developer bearer, by the second construction process.

15. The image forming apparatus according to claim 14, wherein the controller is configured to change the output from one of the internal power supply circuit and the developing power supply, according to the first output pattern data, the detection result from the first rotation position sensor, the second output pattern data, the detection result from the second rotation position sensor, and the reference value of the output from one of the internal power supply circuit and the developing power supply, and change the output from the charging power supply, according to the third output pattern data, the detection result from the first rotation position sensor, the fourth output pattern data, the detection result from the second rotation position sensor, and the reference value of the output from the charging power supply, by the output change process when the image based on the command from the user is formed.

16. The image forming apparatus according to claim 9, wherein the controller is configured to sequentially execute the reference value determination process, the first construction process, the determination process for the reference value of the output from one of the internal power supply circuit and the developing power supply, the data process for the shift when a determination result is inappropriate in the determination process, the second construction process, the determination process for the reference value of the output from the charging power supply, and the data process for the shift when a determination result is inappropriate in the determination process, before a first print job after a factory shipment.

17. The image forming apparatus according to claim 9, further comprising a replacement sensor to detect replacement of the imaging device, wherein the controller is configured to sequentially execute the reference value determination process, the first construction process, the determination process for the reference value of the output from one of the internal power supply circuit and the developing power supply, the data process for the shift when a determination result is inappropriate in the determination process, the second construction process, the determination process for the reference value of the output from the charging power supply, and the data process for the shift when a determination result is inappropriate in the determination process, before a print job is executed, when the replacement is detected by the replacement sensor.

18. The image forming apparatus according to claim 3, wherein the controller is configured to execute a combination of the reference value determination process, the determination process, and the data process for the shift at regular timing.

19. An image forming apparatus comprising:

an imaging device to form a toner image on a moving surface of an image bearer;

a transferer to transfer the toner image on the image bearer to a recording sheet directly or via an intermediate transferer;

a developer bearer that supplies developer to the image bearer;

a rotation position sensor to detect a rotation position of at least one of the image bearer and the developer bearer;

an adhesion amount sensor to detect a toner adhesion amount of the toner image formed by the imaging device;

a power supply to output a voltage contributing to a predetermined process in a course from formation to transfer of the toner image; and a controller to execute a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor obtained when the toner image for the density unevenness detection is formed, an output change process to execute the predetermined process while changing the voltage output from the power supply, according to the detection result from the rotation position sensor and the output pattern data, and a reference value determination process to determine a reference value of an output from the power supply, according to a target toner adhesion amount and a result obtained by detecting toner adhesion amounts of a plurality of toner images for toner adhesion amount detection formed by the imaging device under different imaging conditions by the adhesion amount sensor, wherein the controller executes a correction process to correct a target toner adhesion amount when the reference value determined by the reference value determination process is in a predetermined range within a range from an upper limit to a lower limit of the reference value.

20. An image forming apparatus comprising:

an imaging device to form a toner image on a moving surface of an image bearer;

a transferer to transfer the toner image on the image bearer to a recording sheet directly or via an intermediate transferer;

a rotator;

a rotation position sensor to detect a rotation position of the rotator;

an adhesion amount sensor to detect a toner adhesion amount of the toner image formed by the imaging device;

a power supply to output a voltage contributing to a predetermined process in a course from formation to transfer of the toner image; and a controller to execute a construction process to construct output pattern data to change the voltage output from the power supply, according to a result obtained by detecting a toner adhesion amount of a toner image for density unevenness detection formed by the imaging device by the adhesion amount sensor and a detection result from the rotation position sensor obtained when the toner image for the density unevenness detection is formed, an output change process to execute the predetermined process while changing the voltage output from the power supply, according to the detection result from the rotation position sensor and the output pattern data, and a reference value determination process to determine a reference value of an output from the power supply, according to a result obtained by detecting toner adhesion amounts of a plurality of toner images for toner adhesion amount detection formed by the imaging device under different imaging conditions by the adhesion amount sensor, the controller to determine the reference value as a value in a range from a predetermined lower limit to a predetermined upper limit, wherein the predetermined lower limit and the predetermined upper limit are determined respectively based on a lower limit and a upper limit of the voltage output from the power supply and on an expected amount of change determined by the output change process.

21. The image forming apparatus according to claim 19, wherein after the correction process, the controller determines the reference value from a preceding reference value determination process.

22. The image forming apparatus according to claim 19, wherein after the correction process, the controller determines the reference value from a developing performance $\gamma$ and the corrected target toner adhesion amount.

* * * * *